US008344975B2

(12) United States Patent
Shirouzu et al.

(10) Patent No.: US 8,344,975 B2
(45) Date of Patent: Jan. 1, 2013

(54) EL DISPLAY DEVICE WITH VOLTAGE VARIATION REDUCTION TRANSISTOR

(75) Inventors: Hiroshi Shirouzu, Shiga (JP); Kenichi Tajika, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/440,426

(22) Filed: Apr. 5, 2012

(65) Prior Publication Data

US 2012/0188150 A1 Jul. 26, 2012

Related U.S. Application Data

(63) Continuation of application No. PCT/JP2010/006370, filed on Oct. 28, 2010.

(51) Int. Cl.
*G09G 3/32* (2006.01)

(52) U.S. Cl. ..... 345/82

(58) Field of Classification Search ..... 345/76–83
See application file for complete search history.

(56) References Cited

U.S. PATENT DOCUMENTS

| | | | | |
|---|---|---|---|---|
| 6,064,362 | A | 5/2000 | Brownlow et al. | |
| 6,798,148 | B2 * | 9/2004 | Inukai | 315/169.3 |
| 2004/0036664 | A1 * | 2/2004 | Miyazawa | 345/76 |
| 2005/0140596 | A1 * | 6/2005 | Lee et al. | 345/76 |
| 2006/0066253 | A1 * | 3/2006 | Kim | 315/169.3 |
| 2008/0036371 | A1 * | 2/2008 | Kim | 313/504 |
| 2011/0157126 | A1 * | 6/2011 | Chung et al. | 345/211 |

FOREIGN PATENT DOCUMENTS

| | | |
|---|---|---|
| JP | 5-142573 | 6/1993 |
| JP | 10-062817 | 3/1998 |
| JP | 2000-010072 | 1/2000 |
| JP | 2001-194646 | 7/2001 |
| JP | 2005-202070 | 7/2005 |
| JP | 2008-175945 | 7/2008 |
| JP | 2009-086252 | 4/2009 |

OTHER PUBLICATIONS

International Search Report and Written Opinion, dated Jul. 12, 2010, for parent International Application No. PCT/JP2010/006370.

* cited by examiner

*Primary Examiner* — Liliana Cerullo
(74) *Attorney, Agent, or Firm* — Greenblum & Bernstein, P.L.C.

(57) ABSTRACT

A display device including: scanning lines; data lines; pixels provided in a matrix; and a power line, each of the pixels includes: an organic EL device; a drive transistor which converts a data voltage applied to a gate into a drive current; a capacitor which holds a voltage according to the data voltage; a selector transistor having a gate connected to one of the scanning lines and a source connected to the gate of the drive transistor; a selector transistor having a gate connected to the scanning line, a source connected to a drain of the selector transistor, and a drain connected to the data line; and a guard potential transistor having a gate connected to the source of the selector transistor, a source connected to the drain of the selector transistor, and a drain connected to the power line.

9 Claims, 23 Drawing Sheets

Writing data $V_{P1}$ decreases due to off-leakage current
→ $V_{GS}$ high
→Current from power source
→Restore $V_{P1}$ Displaying $V_{P1}$ increases due to off-leakage current
→$V_{GS}$ low
→Current to power source
→Restore $V_{P1}$ Displaying Writing data When potential in data line is high When potential in data line is low Writing data When potential in data line is low When potential in data line is high Writing data Displaying Displaying

EL DISPLAY DEVICE WITH VOLTAGE VARIATION REDUCTION TRANSISTOR

CROSS REFERENCE TO RELATED APPLICATION

This is a continuation application of PCT Patent Application No. PCT/JP2010/006370 filed on Oct. 28, 2010, designating the United States of America. The entire disclosure of the above-identified application, including the specifications, drawings and claims are incorporated herein by reference in their entirety.

TECHNICAL FIELD

The present disclosure relates to display devices, and particularly relates to a display device using a current-driven light-emitting device.

BACKGROUND ART

A display device using organic electroluminescence (EL) has been known as a display device using current-driven light-emitting device. The organic EL display device using the light-emitting organic EL device does not require a backlight necessary for a liquid crystal display device (LCD), and is suitable for reducing thickness of the device. In addition, since there is no limit on the viewing angle either, the organic EL display device is expected to be in practical application as a next-generation display device. In addition, in the organic EL device used for the organic EL display device, the luminance of each of the light-emitting devices is controlled by a current value flowing in the light-emitting device. In that regard, that organic EL device is different from the liquid crystal cell controlled by the voltage applied thereon.

In the organic EL display device, the organic EL devices composing the pixels are usually arranged in a matrix. A passive-matrix organic EL display refers to a display in which organic EL devices are provided at intersections of row electrodes (scanning lines) and column electrodes (data lines), and the organic EL devices are driven by applying a voltage corresponding to a data signal between a selected row electrode and the column electrodes.

There is another display device in which switching thin film transistors (TFT) are provided at intersections of the scanning lines and the data lines, and gates of the drivers are connected to the switching TFT. The switching TFTs are turned on through the selected scanning lines, and the input of the data signals are provided to the drivers. Such a display device in which the organic EL devices are driven by the drivers is referred to as an active-matrix organic EL display device.

The active-matrix organic EL display device is capable of causing the organic EL devices to emit light until next scanning (selection), and is different from the passive-matrix organic EL display device in which the organic EL devices are connected to the row electrode (scanning line) and emit light only when each of the row electrode (scanning line) is selected. Thus, with the active-matrix organic EL display device, the luminance of the display does not decrease even when the number of the scanning lines increases. Accordingly, the active-matrix organic EL display device can be driven with low voltage, and the power consumption can be reduced.

The patent literature 1 discloses a circuit configuration of a pixel unit in an active-matrix organic EL display device.

FIG. 15 is a diagram illustrating the circuit configuration of the pixel and a connection with a circuit around the pixel included in the display device disclosed in the patent literature 1. A display device 100 illustrated in FIG. 15 includes a pixel array unit in which the pixels 100A are arranged in a matrix and a driver unit which drives the pixel array unit. For description purpose, only one pixel 100A configuring the pixel array unit is described in FIG. 15. The pixel array unit includes scanning lines 102 each provided for each row, data lines 101 each provided for each column, the pixels 100A arranged in rows and columns at the intersections of the scanning lines 102 and the data lines 101, and power supply lines 110 each provided for each row. The driver unit includes a horizontal selector 103, a write scanner 104, and a power drive scanner 105.

The write scanner 104 sequentially supplies, to each of the scanning lines 102, a control signal in a horizontal cycle (1H) so as to scan the pixels per row. The power driver scanner 105 supplies a variable power voltage to the power supply lines 110 in synchronization with the line sequential scanning. The horizontal selector 103 switches between the data voltage which is a video signal and a reference voltage in synchronization with the line sequential scanning and supplies the voltage to the data lines 101 in column.

The pixel 100A includes a drive transistor 111, selector transistors 112*a* and 112*b*, an organic EL device 113 and a capacitor 114. The selector transistors 112*a* and 112*b* are thin film transistors composing a gate group 112. The drive transistor 111 and the organic EL device 113 are connected in series between the power supply line 110 and a reference potential Vcat (for example, the ground potential). With this, the cathode of the organic EL device 113 is connected to the reference potential Vcat, the anode of the organic EL device 113 is connected to the source of the drive transistor 111, and the drain of the drive transistor 111 is connected to the power supply line 110. In addition, the gate of the drive transistor 111 is connected to the first electrode of the capacitor 114, and the other of the source electrode and the drain electrode of the selector transistor 112*b*. The second electrode of the capacitor 114 is connected to the anode of the organic EL device 113.

Furthermore, the other of the source electrode and the drain electrode of the selector transistor 112*a* forming the gate group 112 is connected to one of the source electrode and the drain electrode of the selector transistor 112*b*. The data line 101 and one of the source electrode and the drain electrode of the selector transistor 112*a* are connected. The gates of the selector transistors 112*a* and 112 are connected to the scanning line 102.

In the configuration described above, the power drive scanner 105 switches the power supply line 110 from a first voltage (high voltage) to a second voltage (low voltage) with the data line 101 in a threshold detecting voltage. The write scanner 104 raises the voltage of the scanning 102 to "H" level to turn on the selector transistors 112*a* and 112*b*, with the data line 101 in the threshold detecting voltage, and applies the threshold detecting voltage to the gate of the drive transistor 111. Subsequently, the power driver scanner 105 switches the voltage of the power supply line 110 from the second voltage to the first voltage such that the capacitor 114 holds the voltage corresponding to the threshold voltage of the drive transistor 111, in a correction period before the voltage of the data line 101 switches from the threshold detecting voltage to the data voltage. Next, the write scanner 104 changes the voltages at the selector transistors 112*a* and 112*b* to "H" level such that the capacitor 114 holds the data voltage. To put it differently, the data voltage is added to a voltage corresponding to the threshold voltage of the drive transistor 111 that has been held, and is written on the capacitor 114. Subsequently, the drive transistor 111 receives a current supply from the power supply line 110 in the first voltage and causes the flow of the driving current according to the voltage that is held flows in the organic EL device 113.

As described above, the write scanner 104 writes and holds the data voltage by turning the gate group 112 on and off. The configuration of the gate group 112 in which the two selector transistors are connected in series is referred to as a double-gate structure. With the double-gate structure, the turn-off resistance of the gate group 112 is doubled, and even when one of the selector transistors causes off-leakage, the off-leakage is suppressed by the other selector transistor, reducing the off-leakage current to approximately half.

According to the patent literature 1, the double gate structure allows writing precise luminance information on the pixel, and provides a display device which has high-image quality and does not cause variation in the luminance of the organic EL device 113.

CITATION LIST

Patent Literature

[Patent Literature 1] Japanese Unexamined Patent Application Publication No. 2008-175945

SUMMARY OF INVENTION

Technical Problem

However, with the display device according to the patent literature 1, although the gate group 112 composed of thin film transistors connected in series can reduce the off-leakage current into half, it is difficult to eliminate the off-leakage current completely. Consequently, there is a problem that the charge held by the capacitor 114 is leaked to the data line 101 when holding the data voltage, changing the drive current during the display period.

Conventionally, in order to solve the problem, capacitance of the capacitor is set to be large in advance in consideration of the off-leakage current to suppress the influence of the off-leakage current. However, along with the miniaturization of the light-emitting pixels accompanying the increase in the definition of the display screen, it is increasingly difficult to maintain the size of the capacitor, occupying most of the pixel circuit.

In view of the problem described above, it is an object of the present disclosure to provide a display device having a pixel in which the hold voltage does not temporally change due to the off-leakage current, even if the miniaturization of the pixels advances.

Solution to Problem

In order to achieve the above object, a display device according to an aspect of the present disclosure is a display device including: a plurality of scanning lines; a plurality of data lines; a plurality of pixels each provided at an intersection of one of the scanning lines and one of the data lines; and a power line for supplying current to the pixels, in which each of the pixels includes: a light-emitting device which emits light according to a flow of a drive current corresponding to a data voltage supplied through one of the data lines; a drive transistor which is connected between the power line and the light-emitting device and which converts the data voltage into the drive current, according to a voltage applied to a gate electrode; a capacitor which has one electrode connected to the gate electrode of the drive transistor and which holds a voltage according to the data voltage; a first transistor having a gate electrode connected to one of the scanning lines and one of a source electrode and a drain electrode connected to the gate electrode of the drive transistor; a second transistor having a gate electrode connected to the scanning line, one of a source electrode and a drain electrode connected to the other of the source electrode and the drain electrode of the first transistor, and the other of the source electrode and the drain electrode connected to the data line; and a third transistor having a gate electrode connected to the one of the source electrode and the drain electrode of the first transistor, a source electrode connected to the other of the source electrode and the drain electrode of the first transistor, and a drain electrode connected to a first potential line.

Advantageous Effects of Invention

With the display device according to the present disclosure, the off-leakage current from the capacitor included in the pixel to the data line is eliminated, and the area of capacitor occupying the most of the area of the pixel circuit can be reduced. Therefore, it is possible to miniaturize the pixel while maintaining the display quality.

BRIEF DESCRIPTION OF DRAWINGS

These and other objects, advantages and features of the invention will become apparent from the following description thereof taken in conjunction with the accompanying drawings that illustrate a specific embodiment of the present invention. In the Drawings.

DESCRIPTION OF EMBODIMENTS

Figure 1:
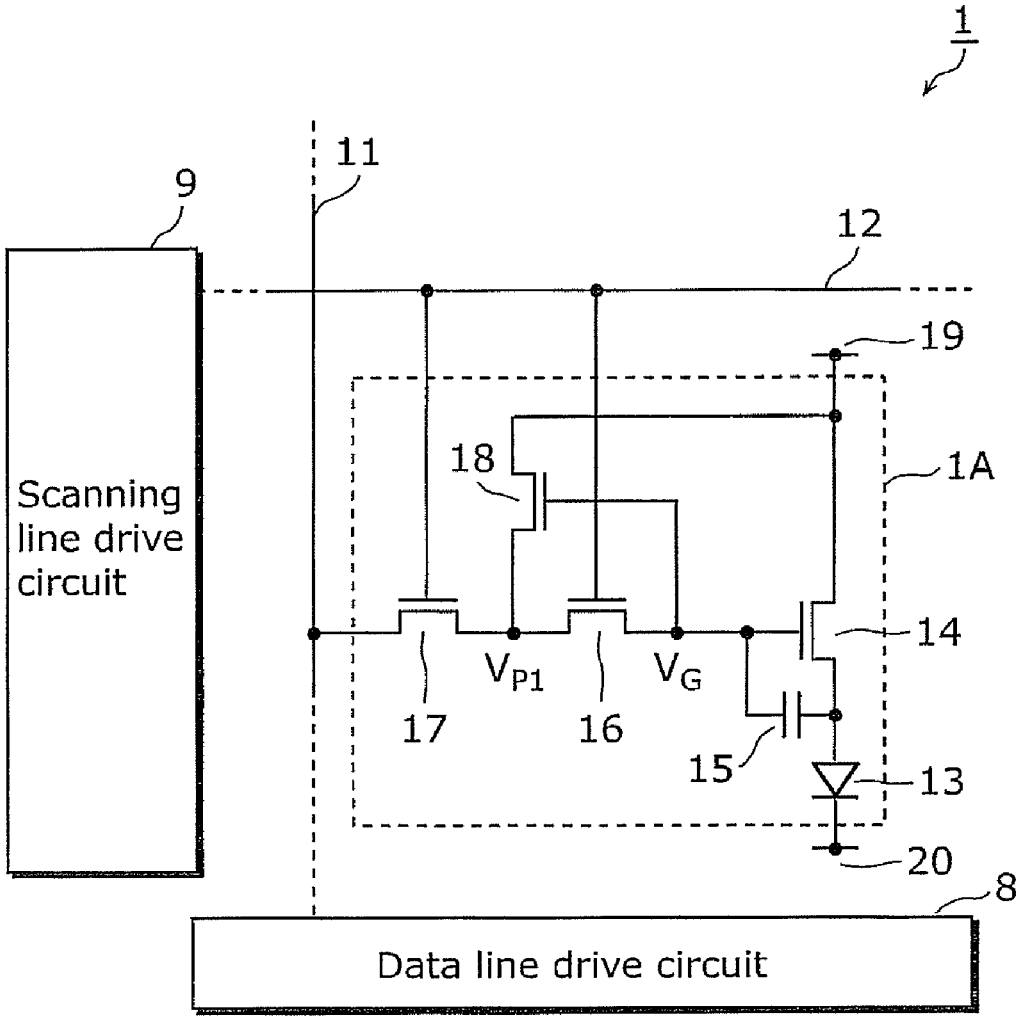
FIG. 1 is a diagram illustrating the circuit configuration of the pixel and connections with the circuits around the pixel included in the display device according to the embodiment 1 of the present disclosure.

In order to achieve the above object, a display device according to an aspect of the present disclosure is a display device including: a plurality of scanning lines; a plurality of data lines; a plurality of pixels each provided at an intersection of one of the scanning lines and one of the data lines; and a power line for supplying current to the pixels, in which each of the pixels includes: a light-emitting device which emits light according to a flow of a drive current corresponding to a data voltage supplied through one of the data lines; a drive transistor which is connected between the power line and the light-emitting device and which converts the data voltage into the drive current, according to a voltage applied to a gate electrode; a capacitor which has one electrode connected to the gate electrode of the drive transistor and which holds a voltage according to the data voltage; a first transistor having a gate electrode connected to one of the scanning lines and one of a source electrode and a drain electrode connected to the gate electrode of the drive transistor; a second transistor having a gate electrode connected to the scanning line, one of a source electrode and a drain electrode connected to the other of the source electrode and the drain electrode of the first transistor, and the other of the source electrode and the drain electrode connected to the data line; and a third transistor having a gate electrode connected to the one of the source electrode and the drain electrode of the first transistor, a source electrode connected to the other of the source electrode and the drain electrode of the first transistor, and a drain electrode connected to a first potential line.

According to this aspect, a configuration for preventing a change in the potential at a point connecting a first transistor and a second transistor, which are two selector transistors connected in series. More specifically, a third transistor which is a guard potential transistor is provided such that the potential at the connecting point does not change, even if an off-leakage current is generated at the first and second transistors. With this configuration, current flows between the first potential line and the connecting point, according to the potential difference between the gate and the source of the third transistor generated due to the off-leakage current. More specifically, the current is for maintaining the potential at the connecting point at the potential before the change. Accordingly, the potential of the capacitor holding the voltage is maintained without change, and a voltage according to a precise data voltage can be held. Thus, it is possible to cause the light-emitting device to emit light at a desired luminance. In addition, it is not necessary to design the electrodes of the capacitor to have a large area in consideration of the voltage variation due to the off-leakage current. Thus, it is possible to reduce the area of the electrodes of the capacitor compared to the conventional configuration, enabling the miniaturization of the pixels.

In the display device according to an aspect of the present disclosure the drive transistor, the first transistor, the second transistor, and the third transistor may be n-type transistors, and the first potential line may be the power line having a potential, with respect to a reference potential, set to be equal to or higher than a highest voltage held by the capacitor.

According to this aspect, when a voltage lower than the writing voltage is applied to the data line, that is, when the voltage in the data line is lower than the voltage held by the capacitor, the off-leakage current is generated from the capacitor, the first transistor, the second transistor, to the data line, when the capacitor holds the voltage. In this case, according to the gate-source voltage in the third transistor, current flows from the power line, the third transistor, the connecting point, the second transistor, to the data line, and thus, the potential at the connecting point is maintained at a potential when there is no off-leakage potential.

In the display device according to an aspect of the present disclosure the drive transistor, the first transistor, the second transistor, and the third transistor may be p-type transistors, and the first potential line may be the scanning line.

According to this aspect, when a voltage higher than the writing voltage is applied to the data line, that is, when the voltage in the data line is higher than the voltage held by the capacitor, the off-leakage current is generated from the data line, the second transistor, the first transistor, to the capacitor, when the capacitor holds the voltage. In this case, the current flows from the data line, the second transistor, the connecting point, the third transistor, to the scanning line, according to the gate-source voltage in the third transistor. Thus, the potential at the connecting point is maintained at the potential when there is no off-leakage current. Here, it is necessary for a scanning signal voltage for turning the first and second transistors off to be set at a voltage value equal to or lower than the lowest voltage held by the capacitor.

The display device according to an aspect of the present disclosure includes, for example, a fourth transistor having a gate electrode connected to a drain electrode, the drain electrode connected to the other of the source electrode and the drain electrode of the first transistor, and a source electrode connected to a second potential line.

According to this aspect, in addition to introducing the guard potential to the connecting point, the connecting point is connected to the second potential line through the diode-connected fourth transistor such that the connecting point has the voltage change reducing function. Accordingly, when the voltage in the data line is higher than the writing voltage (when all of the transistors are of n-type transistors), or when the voltage in the data line is lower than the writing voltage (when all of the transistors are of p-type transistors), the potential at the connecting point is maintained at a constant value, due to current flowing between the second potential line and the connecting point. More specifically, by providing the fourth transistor, the potential at the connecting point is maintained at a constant value regardless of the amount of the voltage in the data line, and thus it is possible to maintain the potential at the capacitor at a constant value when holding voltage.

In the display device according to an aspect of the present disclosure, the fourth transistor may be an n-type transistor, and the second potential line may be a second power line having a potential, with respect to a reference potential, set to be equal to or lower than a lowest voltage held by the capacitor.

According to this aspect, when the voltage in the data line is higher than the writing voltage, the current flows from the data line, the second transistor, the connecting point, the fourth transistor, to the second potential line. Therefore, the potential at the connecting point is maintained at a constant value. Thus, it is possible to maintain the potential at the capacitor at a constant value when the capacitor holds the voltage.

In the display device according to an aspect of the present disclosure, the second potential line may be connected to an anode electrode of the light-emitting device.

According to this aspect, without separately providing a power source having a potential, with respect to the reference potential, set to be equal to of lower than the lowest voltage held by the capacitor, the anode electrode of the light-emitting device satisfying the requirements for the potential described above may be used. This simplifies the pixel circuit.

In the display device according to an aspect of the present disclosure, the fourth transistor may be a p-type transistor, and the second potential line may be the power line having a potential, with respect to a reference potential, set to be equal to or higher than a highest voltage held by the capacitor.

According to this aspect, when the voltage in the data line is lower than the writing voltage, the current flows from the power line, the fourth transistor, the connecting point, the second transistor, to the data line, maintaining the potential at the connecting point at a constant value.

The display device according to an aspect of the present disclosure is, for example, a display device including: a plurality of scanning lines; a plurality of data lines; a plurality of pixels each provided at an intersection of one of the scanning lines and one of the data lines; and a power line for supplying current to the pixels, wherein each of said pixels includes: a light-emitting device which emits light according to a flow of a drive current corresponding to a data voltage; a drive transistor which is connected between the power line and the light-emitting device and which converts the data voltage into the drive current, according to a voltage applied to a gate electrode; a capacitor which has one electrode connected to the gate electrode of the drive transistor and which holds a voltage according to the data voltage; a first transistor having a gate electrode connected to one of the scanning lines and one of a source electrode and a drain electrode connected to the gate electrode of the drive transistor; a second transistor having a gate electrode connected to the scanning line, and one of a source electrode and a drain electrode connected to the other of the source electrode and the drain electrode of the first transistor; a fifth transistor having a gate electrode connected to the scanning line, one of a source electrode and a drain electrode connected to the other of the source electrode and the drain electrode of the second transistor, and the other of the source electrode and the drain electrode connected to the data line; a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the second transistor, and a source electrode connected to a second potential line.

According to this aspect, a configuration for preventing a change in the potential at a first connecting point connecting a first transistor and a second transistor, which are two selector transistors connected in series. More specifically, a third transistor which is the guard potential transistor and a fourth transistor which is a diode-connected voltage change reduction transistor are provided for preventing the change in the potential at the first connecting point even when there is an off-leakage current in the first and second transistors. Accordingly, the potential of the capacitor holding the voltage is maintained without change, and a voltage according to a precise data voltage can be held when the capacitor is holding the voltage. Thus, it is possible to cause the light-emitting device to emit light at a desired luminance. In addition, it is not necessary to design the electrodes of the capacitor to have a large area in consideration of the voltage variation due to the off-leakage current. Thus, it is possible to reduce the area of the electrodes of the capacitor compared to the conventional configuration, enabling the miniaturization of the pixels. Furthermore, the second transistor is interposed between the first connecting point at which the guard potential is introduced and the second connecting point connected to the second potential line through the fourth transistor. Thus, a flow-through current does not flow between the first potential line and the second potential line, maintaining the potential at the first connecting point at a constant value while suppressing the power consumption.

in the display device according to an aspect of the present disclosure, the drive transistor, the first transistor, the second transistor, the third transistor, the fourth transistor, and the fifth transistor may be n-type transistors, the first potential line may be the power line having a potential, with respect to a reference potential, set to be equal to or higher than a highest voltage held by the capacitor, and the second potential line may be a second power line having a potential, with respect to the reference potential, set to be equal to or lower than a lowest voltage held by the capacitor.

According to this aspect, when the capacitor holds the voltage, the current flows from the power line, the third transistor, the first connecting point, the second transistor, the second connecting point, the fourth transistor, to the second potential line, according to the gate-source voltage in the third transistor. Thus, the potential at the first connecting point is maintained at the potential when there is no off-leakage current. Furthermore, the second transistor is interposed between the first connecting point at which the guard potential is introduced and the second connecting point. Thus, no flow-through current flows between the first potential line and the second potential line, maintaining the potential at the first connecting point at a constant value while suppressing the power consumption.

In the display device according to an aspect of the present disclosure, the drive transistor, the first transistor, the second transistor, the third transistor, the fourth transistor, and the fifth transistor are p-type transistors, the first potential line is the scanning line, and the second potential line is the power line having a potential, with respect to the reference potential, set to be equal to or higher than a highest voltage held by the capacitor.

According to this aspect, the current flows from the power line, the fourth transistor, the second connecting point, the second transistor, the first connecting point, the third transistor, to the scanning line, when the capacitor holds the voltage, according to the gate-source voltage in the third transistor. Thus, the potential at the first connecting point is maintained at the potential when there is no off-leakage current. Furthermore, the second transistor is interposed between the first connecting point at which the guard potential is introduced and the second connecting point. Thus, no flow-through current flows between the first potential line and the second potential line, maintaining the potential at the first connecting point at a constant value while suppressing the power consumption.

Embodiment 1

The following shall describe the embodiment 1 of the present disclosure with reference to the drawings.

FIG. 1 illustrates the circuit configuration of the pixel and the connections with the circuits around the pixel included in the display device according to the embodiment 1 of the present disclosure. The display device 1 illustrated in FIG. 1 includes a pixel 1A, a data line drive circuit 8, a scanning line drive circuit 9, a data line 11, a scanning line 12, and a power lines 19 and 20. In FIG. 1, only one pixel 1A is described for convenience, however, the pixels 1A are arranged in a matrix at the intersections of the scanning lines 12 and the data lines 11 and configure the display unit. The data line 11 is provided for each column of the pixels, and the scanning line 12 is provided for each row of the pixels.

The pixel 1A includes the organic EL device 13, the drive transistor 14, the capacitor 15, the selector transistors 16 and 17, and the guard potential transistor 18.

The scanning line drive circuit 9 is a drive circuit connected to the scanning lines 12, and controls the conduction and non-conduction of the selector transistors 16 and 17 included in the pixel 1A for each row by outputting the scanning signal to the scanning line 12.

The data line drive circuit 8 is a drive circuit connected to the data lines 11, and capable of outputting the data voltage based on the video signal to the pixel 1A.

The data line 11 is connected to the data line drive circuit 8, and is connected to the pixel belonging to the column of pixels including the pixel 1A, and is capable of supplying the data voltage that determines the intensity of light emission.

The scanning line 12 is connected to the scanning line drive circuit 9, and is connected to each of the pixels belonging to the pixel row including the pixel 1A. With this, the scanning line 12 is capable of providing the timing for writing the data voltage on the pixels belonging to the pixel row including the pixel 1A.

The selector transistor 16 is a first transistor having the gate electrode connected to the scanning line 12, one of the source electrode and the drain electrode connected to the gate electrode of the drive transistor 14, and switches between the conduction and the non-conduction of the data line 11 and the pixel 1A in synchronization with the selector transistor 17 by the scanning signal from the scanning line 12. The selector transistor 16 is configured of an n-type thin film transistor (n-type TFT).

The selector transistor 17 is a second transistor having the gate electrode connected to the scanning line 12, one of the source electrode and the drain electrode connected to the other of the source electrode and the drain electrode of the selector transistor 16, and the other of the source electrode and the drain electrode connected to the data line 11, and switches between the conduction and non-conduction of the data line 11 and the pixel 1A in synchronization with the selector transistor 16 by the scanning signal from the scanning line 12. The selector transistor 17 is configured of an n-type thin film transistor (n-type TFT).

In the following description, the point at which the other of the source electrode and the drain electrode of the selector transistor 16 and one of the source electrode and the drain electrode of the selector transistor 17 are connected is referred to as a first connecting point. A point at which one of the source electrode and the drain electrode of the selector transistor 16, the first electrode of the capacitor 15, and the gate electrode of the drive transistor 14 are connected is referred to as a capacitor connecting point.

The drive transistor 14 has the drain electrode connected to the power line 19 which is the positive power line, and the source electrode connected to the anode electrode of the organic EL device 13. The drive transistor 14 converts the voltage corresponding to the data voltage applied between the gate and the source into a drain current corresponding to the data voltage. The drain current is supplied to the organic EL device 13 as the drain current. The drive transistor 14 is configured of an n-type thin film transistor (n-type TFT).

The organic EL device 13 is a light-emitting device having a cathode electrode connected to the power line 20 set to the reference potential or the ground potential, and emits light when the drive current flows by the drive transistor 14. In the following description, the potential difference from the reference potential is defined as the potential at each line, electrode or connecting point.

The capacitor 15 has the first electrode which is one of the electrodes connected to the gate electrode of the drive transistor 14, and the second electrode connected to the source electrode of the drive transistor 14, capable of holding a voltage according to the data voltage, for example, after the selector transistors 16 and 17 are turned off, stably holding the gate-source voltage of the drive transistor 14, and stabilizing the drive current supplied from the drive transistor 14 to the organic EL device 13. Note that, in the case of the active-matrix display device, it is necessary to have high capacitance of the capacitor 15 so as to maintain the light-emission state in one frame period. Accordingly, the ratio of the area of a pair of opposing electrodes of the capacitor 15 to the pixel increases. Accordingly, in order to miniaturize the pixels along with the increase in the definition of the display screen, it is important to reduce the area for the electrodes of the capacitor 15.

The guard potential transistor 18 is a third transistor having the gate electrode connected to one of the source electrode and the drain electrode of the selector transistor 16, and the source electrode connected to the other of the source electrode and the drain electrode of the selector transistor 16, and the drain electrode connected to the power line 19. The guard potential transistor 18 is configured of an n-type thin film transistor (n-type TFT).

Here, the power line 19 has the potential set to be equal to or higher than the highest voltage held by the capacitor 15. With this connection, when the selector transistors 16 and 17 are turned off and the capacitor 15 is holding the voltage, the guard potential transistor 18 causes a flow of current corresponding to the gate-source voltage ($V_G$–$V_{P1}$) generated by an off-leakage current flowing from one of the source electrode and the drain electrode of the selector transistor 16 to the other of the source electrode and the drain electrode of the selector transistor 16, from the power line 19, the guard potential transistor 18, the first connecting point, the selector transistor 17, to the data line 11. This current maintains the potential $V_{P1}$ at the first connecting point at a potential before the off-leakage current is generated. The current flows corresponding to the amount of the gate-source voltage ($V_G$–$V_{P1}$) at the guard potential transistor 18. Accordingly, when the capacitor 15 holds voltage, the potential $V_G$ at the capacitor connecting point does not change, and the voltage corresponding to the accurate data voltage is held. With this, the organic EL device 13 can emit light at a desired luminance. In other words, $V_{P1}$ serves as the guard potential of $V_G$. In addition, it is not necessary to design the electrodes of the capacitor 15 to have a large area in consideration of the voltage variation due to the off-leakage current. Thus, it is possible to reduce the area of the electrodes of the capacitor compared to the conventional configuration, enabling the miniaturization of the pixels.

Note that, the guard potential transistor 18 may have the drain electrode connected to the first potential line, different from the power line 19. In this case, it is necessary for the first potential line to be set to the potential equal to or higher than the highest voltage held by the capacitor 15 as well. Note that, having the first potential line as the power line 19 can reduce the number of fixed potential lines as in the embodiment 1. Therefore, it is possible to simplify the circuit configuration.

Furthermore, although not illustrated in FIG. 1, power lines 19 and 20 are connected to the other pixels and a voltage source.

Next, the function of the guard potential transistor 18 shall be described with reference to a state transition diagram of the pixel circuit.

Figure 2A:
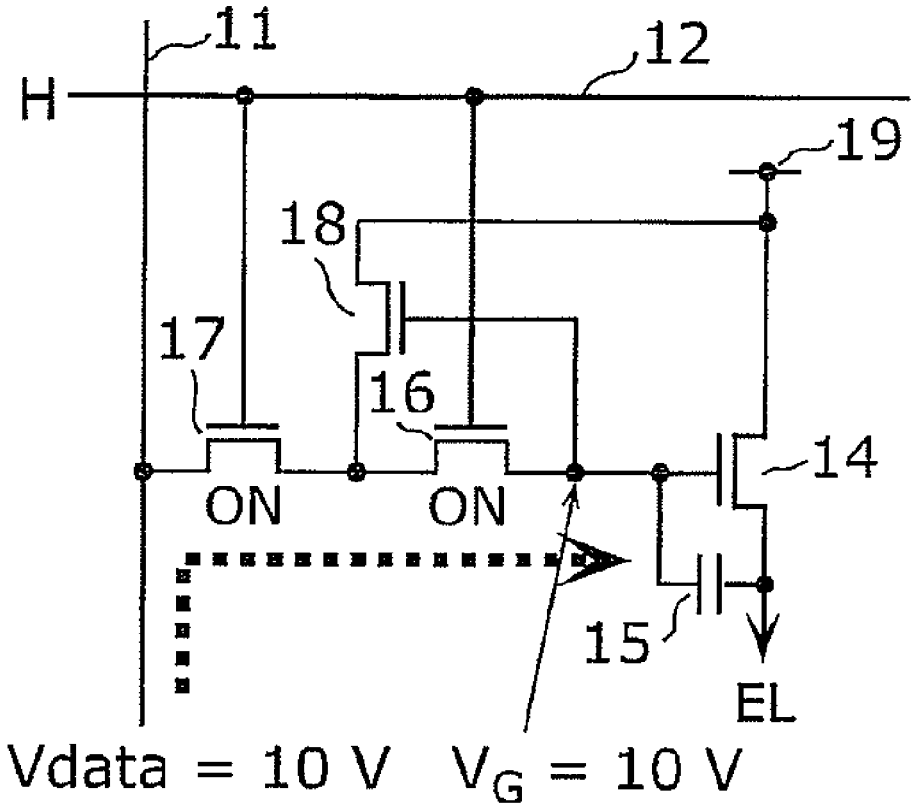
FIG. 2A is a circuit diagram illustrating a state when writing data on the pixel according to the embodiment 1 of the present disclosure.

FIG. 2A is a circuit diagram illustrating the state of the pixel according to the embodiment 1 of the present disclosure when writing data.

First, when writing data on the pixel 1A, the scanning line 12 changes to high level by the scanning line drive circuit 9, turning on the selector transistors 16 and 17. With this, the data line 11 and the capacitor connecting point are conducted. Here, the data line 11 is in the data voltage level by the data line drive circuit 8. Thus, the voltage corresponding to the data voltage is held by the capacitor 15. For example, the range of the data voltage Vdata is 0 to 10 V, and when writing data as in FIG. 2A, Vdata=10V is written, setting $V_G$=10 V. In addition, here, the voltage of the power line 19 is set to be 10 V.

Figure 2B:
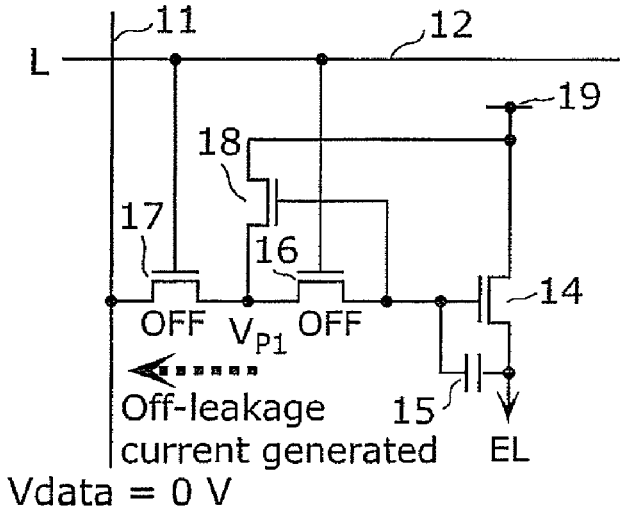
FIG. 2B is a circuit diagram illustrating a state when the pixel according to the embodiment 1 is in display operation.

FIG. 2B is a circuit diagram illustrating a state when the pixel according to the embodiment 1 is in display operation. In the display operation illustrated in FIG. 2B, it is assumed that the potential of the data line 11 is Vdata=0V.

Next, when the pixel 1A is in display operation, the scanning line 12 is in low level by the scanning line drive circuit 9, turning off the selector transistors 16 and 17. Here, the off-leakage current is generated at the selector transistors 16 and 17. The off-leakage current flows from the capacitor connecting point, the selector transistor 16, the first connecting point, the selector transistor 17, to the data line 11, due to the relationship between the potential ($V_G$=10 V) at the capacitor connecting point and the potential (Vdata=0 V) at the data line 11. Here, if the guard potential transistor 18 is not provided, the potential $V_G$ at the capacitor connecting point cannot be maintained at 10 V due to the voltage drop caused by the off-leakage current, and the potential $V_G$ temporally decreases from 10 V.

In contrast, since the guard potential transistor 18 is provided in the embodiment 1, the potential $V_{P1}$ at the first connecting point is maintained. First, the off-leakage current causes a potential difference between the source and the drain of the selector transistor 16. The potential difference is the gate-source voltage of the guard potential transistor 18 as well. Thus, in the guard potential transistor 18, the drain current corresponding to the gate-source voltage flows from the power line 19, the guard potential transistor 18, the first connecting point, the selector transistor 17, to the data line 11. Since the drain current flows according to the amount of the gate-source voltage ($V_G$–$V_{P1}$) in the guard potential transistor 18, the potential $V_{P1}$ at the first connecting point is restored to 10 V, which is the potential before the flow of the off-leakage current, maintaining the initial potential.

Note that, when the pixel 1A is in the display operation, the potential of $V_{P1}$ is always smaller than the potential of $V_G$ by the sub-threshold voltage generated between the gate and the source of the guard potential transistor 18 in the steady state. This potential difference does not depend on the data voltage, and thus, the potential difference does not affect the function of the $V_{P1}$ as the guard potential and maintaining the initial potential.

According to the embodiment 1 described above, when a voltage lower than the writing voltage is applied to the data line, that is, when the voltage at the data line 11 is lower than the voltage held by the capacitor 15, the off-leakage current is generated from the capacitor 15, the selector transistor 16, the first connecting point, the selector transistor 17, to the data line 11, when the capacitor 15 is holding the voltage. In this case, according to the gate-source voltage in the guard potential transistor 18, the current flows from the power line 19, the guard potential transistor 18, the first connecting point, the selector transistor 17, to the data line 11. Thus, the potential $V_{P1}$ at the first connecting point is maintained at the potential when there is no off-leakage current. Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 15 to have a large area in consideration of the voltage variation due to the off-leakage current. Thus, it is possible to reduce the area of the electrodes of the capacitor compared to the conventional configuration, enabling the miniaturization of the pixels.

The configuration described above is also effective for display operation with high writing voltage, and prevents temporal variation in the hold voltage of the pixel displaying high luminance.

Figure 2B:
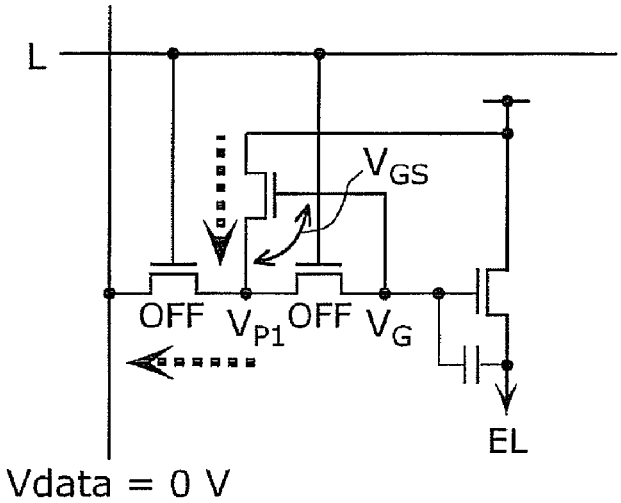
Figure 3:
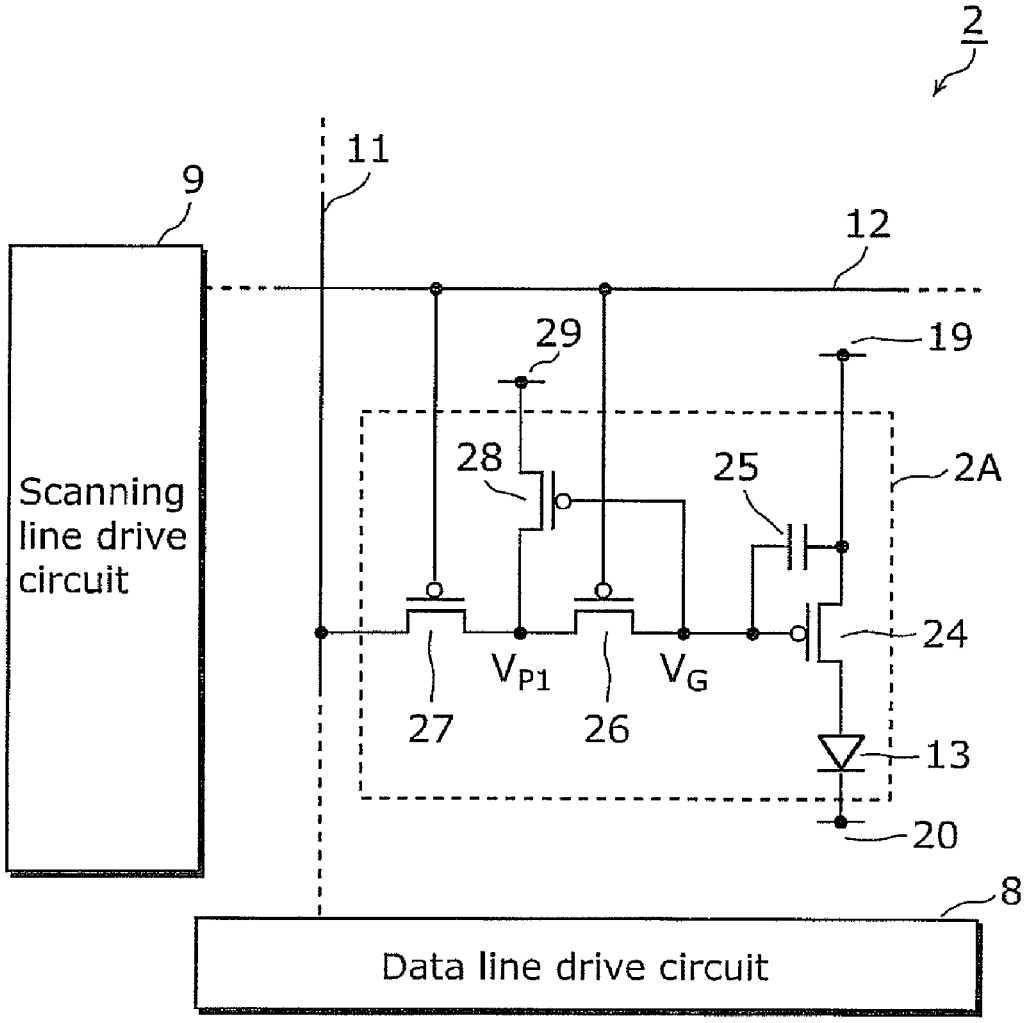
FIG. 3 is a diagram illustrating the circuit configuration of the pixel and connections with the circuits around the pixel included in the display device according to the variation of the embodiment 1 of the present disclosure.

FIG. 3 illustrates the circuit configuration of the pixel and the connections with the circuits around the pixel included in the display device according to the variation of the embodiment 1 of the present disclosure. The display device 2 illustrated in FIG. 2 includes the pixel 2A, the data line drive circuit 8, the scanning line drive circuit 9, the data line 11, the scanning line 12, the power lines 19 and 20, and a fixed potential line 29. In FIG. 3, only one pixel 2A is described for convenience, however, the pixels 2A are arranged in a matrix at the intersections of the scanning lines 22 and the data lines 11 and configure the display unit. The data line 11 is provided for each column of the pixels, and the scanning line 12 is provided for each row of the pixels.

The pixel 2A includes the organic EL device 13, the drive transistor 24, the capacitor 25, the selector transistors 26 and 27, and the guard potential transistor 28.

The display device 2 illustrated in FIG. 3 is different from the display device 1 illustrated in FIG. 1 in that the transistors are p-type transistors. In the following description, description for the components identical to those in the display device 1 shall be omitted, and the description shall be made focusing on the difference.

The selector transistor 26 is a first transistor having the gate electrode connected to the scanning line 12, one of the source electrode and the drain electrode connected to the gate electrode of the drive transistor 24, and switches the conduction and the non-conduction of the data line 11 and the pixel 2A in synchronization with the selector transistor 27 by the scanning signal from the scanning line 12. The selector transistor 26 is configured of a p-type thin film transistor (p-type TFT).

The selector transistor 27 is a second transistor having the gate electrode connected to the scanning line 12, one of the source electrode and the drain electrode connected to the other of the source electrode and the drain electrode of the selector transistor 26, and the other of the source electrode and the drain electrode connected to the data line 11, and switches between the conduction and non-conduction of the data line 11 and the pixel 2A in synchronization with the selector transistor 26 by the scanning signal from the scanning line 12. The selector transistor 27 is configured of a p-type thin film transistor (p-type TFT).

In the following description, the point connecting the other of the source electrode and the drain electrode of the selector transistor 26 and one of the source electrode and the drain electrode of the selector transistor 27 is referred to as the first connecting point. A point at which one of the source electrode and the drain electrode of the selector transistor 26, the first electrode of the capacitor 25, and the gate electrode of the drive transistor 24 are connected is referred to as a capacitor connecting point.

The drive transistor 24 has the source electrode connected to the power line 19 which is the positive power line, and the drain electrode connected to the anode electrode of the organic EL device 13. The drive transistor 24 converts the voltage corresponding to the data voltage applied between the gate and the source into a drain current corresponding to the data voltage. The drain current is supplied to the organic EL device 13 as the drive current. The drive transistor 24 is configured of a p-type thin film transistor (p-type TFT).

The organic EL device 13 is a light-emitting device having a cathode electrode connected to the power line 20 set to the reference potential or the ground potential, and emits light when the drive current by the drive transistor 24 flows. In the following description, the potential difference from the reference potential is defined as the potential at each line, electrode or connecting point.

The capacitor 25 has the first electrode which is one of the electrodes connected to the gate electrode of the drive transistor 24, and the second electrode connected to the source electrode of the drive transistor 24, capable of holding a voltage according to the data voltage, for example, after the selector transistors 26 and 27 are turned off, stably holding the gate-source voltage of the drive transistor 24, and stabilizing the drive current supplied from the drive transistor 24 to the organic EL device 13.

The guard potential transistor 28 has the gate electrode connected to one of the source electrode and the drain electrode of the selector transistor 26, and the source electrode connected to the other of the source electrode and the drain electrode of the selector transistor 26, and the drain electrode connected to the fixed potential line 29. The drive transistor 28 is configured of a p-type thin film transistor (p-type TFT).

Here, the fixed potential line 29 is set to have a potential equal to or lower than the lowest voltage held by the capacitor 25. With this connection, when the selector transistors 26 and 27 are turned off and the capacitor 25 is holding the voltage, the guard potential transistor 28 causes a flow of current corresponding to the gate-source voltage ($V_G$–$V_{P1}$) generated due to the off-leakage current flowing from the other of the source electrode and the drain electrode of the selector transistor 26 to one of the source electrode and the drain electrode of the selector transistor 26 from the data line 11, the selector transistor 17, the first connecting point, the guard potential transistor 28, to the fixed potential line 29. This current maintains the potential $V_{P1}$ at the first connecting point at a potential before the off-leakage current is generated. The current flows corresponding to the amount of the gate-source voltage ($V_G$–$V_{P1}$) at the guard potential transistor 28. Accordingly, when the capacitor 25 is holding the voltage, the potential $V_G$ at the capacitor connecting point does not change, and the voltage corresponding to the accurate data voltage is held. With this, the organic EL device 13 can emit light at a desired luminance. In other words, $V_{P1}$ serves as the guard potential of $V_G$. In addition, it is not necessary to design the electrodes of the capacitor 25 to have a large area in consideration of the voltage variation due to the off-leakage current. Thus, it is possible to reduce the area of the electrodes of the capacitor compared to the conventional configuration, enabling the miniaturization of the pixels.

Note that, the guard potential transistor 28 may have the drain electrode connected to the scanning line 12 different from the fixed potential line 29. In this case, it is necessary for the scanning line potential for turning off the selector transistors 26 and 27 set at a potential equal to or less than the lowest voltage held by the capacitor 25. With the configuration described above, by having the guard potential transistor 28 connected to the scanning line 12 can reduce the number of the fixed potential lines, thereby simplifying the circuit configuration.

Next, the function of the guard potential transistor 28 shall be described with reference to a state transition diagram of the pixel circuit.

Figure 4A:
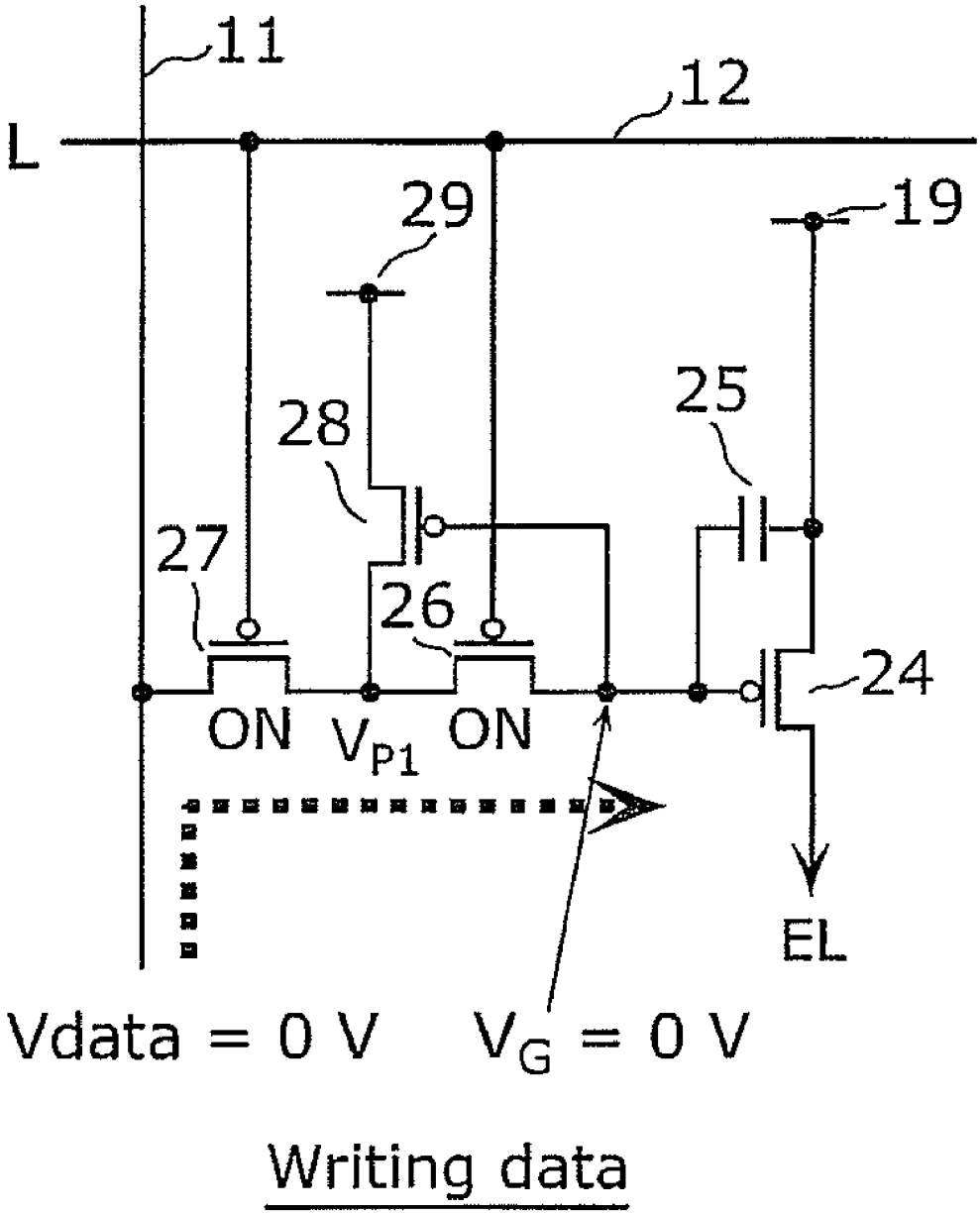
FIG. 4A is a circuit diagram illustrating a state when writing data on the pixel according to the variation in the embodiment 1 of the present disclosure.

FIG. 4A is a circuit diagram illustrating the state of the pixel according to the embodiment 1 of the present disclosure when writing data.

First, when writing data on the pixel 2A, the scanning line 12 changes to low level by the scanning line drive circuit 9, turning on the selector transistors 26 and 27. With this, the data line 11 and the capacitor connecting point are conducted. Here, the data line 11 is in the data voltage level by the data line drive circuit 8. Thus, the voltage corresponding to the data voltage is held by the capacitor 25. For example, the range of the data voltage Vdata is 0 to 10 V, and when writing data as in FIG. 4A, Vdata=0 V is written, setting $V_G$=0 V. Here, the voltage of the fixed potential line 29 is set to be 0 V, for example.

Figure 4B:
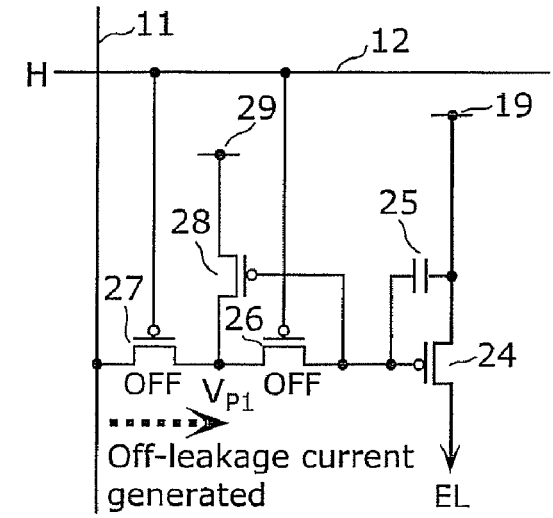
FIG. 4B is a circuit diagram illustrating a state when the pixel according to the variation in the embodiment 1 is in display operation.
Figure 4B:
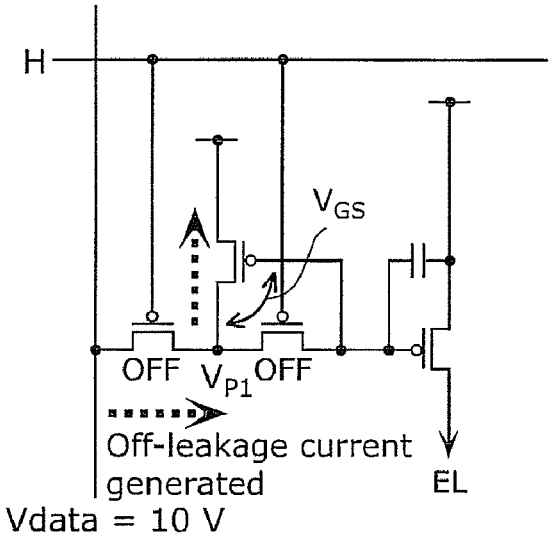

FIG. 4B is a circuit diagram illustrating a state when the pixel according to the variation in the embodiment 1 is in display operation. In the display operation illustrated in FIG. 4B, it is assumed that the potential of the data line 11 is Vdata=10 V.

Next, when the pixel 2A is in display operation, the scanning line 12 is in high level by the scanning line drive circuit 9, turning off the selector transistors 26 and 27. Here, the off-leakage current is generated at the selector transistors 26 and 27. The off-leakage current flows from the data line 11, the selector transistor 27, the first connecting point, the selector transistor 26, to the capacitor connecting point, due to the relationship between the potential ($V_G$=0V) at the capacitor connecting point and the potential (Vdata=10V) at the data line 11. Here, if the guard potential transistor 28 is not provided, the potential $V_G$ at the capacitor connecting point cannot be maintained at 0V due to the voltage increase caused by the off-leakage current, and the potential $V_G$ temporally increases from 0 V.

In contrast, since the guard potential transistor 28 is provided in the embodiment 1, the potential $V_{P1}$ at the first connecting point is maintained. First, the off-leakage current causes a potential difference between the source and the drain of the selector transistor 26. The potential difference is the gate-source voltage of the guard potential transistor 28 as well. Accordingly, a drain current corresponding to the gate-source voltage of the guard potential transistor 28 flows from the data line 11, selector transistor 27, the first connecting point, the guard potential transistor 28, to the fixed potential line 29. Since the drain current flows according to the amount of the gate-source voltage ($V_G$–$V_{P1}$) in the guard potential transistor 28, the potential $V_{P1}$ at the first connecting point is restored to 0 V, which is the potential before the flow of the off-leakage current, maintaining the initial potential.

Note that, when the pixel 2A is in the display operation, the potential of $V_{P1}$ is always higher than the potential of $V_G$ by the sub-threshold voltage generated between the gate and the source of the guard potential transistor 28 in the steady state. This potential difference does not depend on the data voltage, and thus, the potential difference does not affect on the function of the $V_{P1}$ as the guard potential and maintaining the initial potential.

According to the embodiment described above, when a voltage higher than the writing voltage is applied to the data line 11, that is, when the voltage at the data line 11 is higher than the holding voltage of the capacitor 25, the off-leakage voltage is generated from the data line 11, selector transistor 27, the first connecting point, the selector transistor 26, and the capacitor 25, when the capacitor 25 is holding the voltage. In this case, according to the gate-source voltage of the guard potential transistor 28, the current flows from the data line 11, the selector transistor 27, the first connecting point, the guard potential transistor 28, to the fixed potential line 29. Thus, the potential $V_{P1}$ at the first connecting point is maintained at the potential when there is no off-leakage current. Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 25 to have a large area in consideration of the voltage variation due to the off-leakage current. Thus, it is possible to reduce the area of the electrodes of the capacitor compared to the conventional configuration, enabling the miniaturization of the pixels.

The configuration described above is also effective for display operation with low writing voltage, and is capable of preventing temporal variation in the hold voltage of the pixel displaying high luminance, for example.

Figure 5:
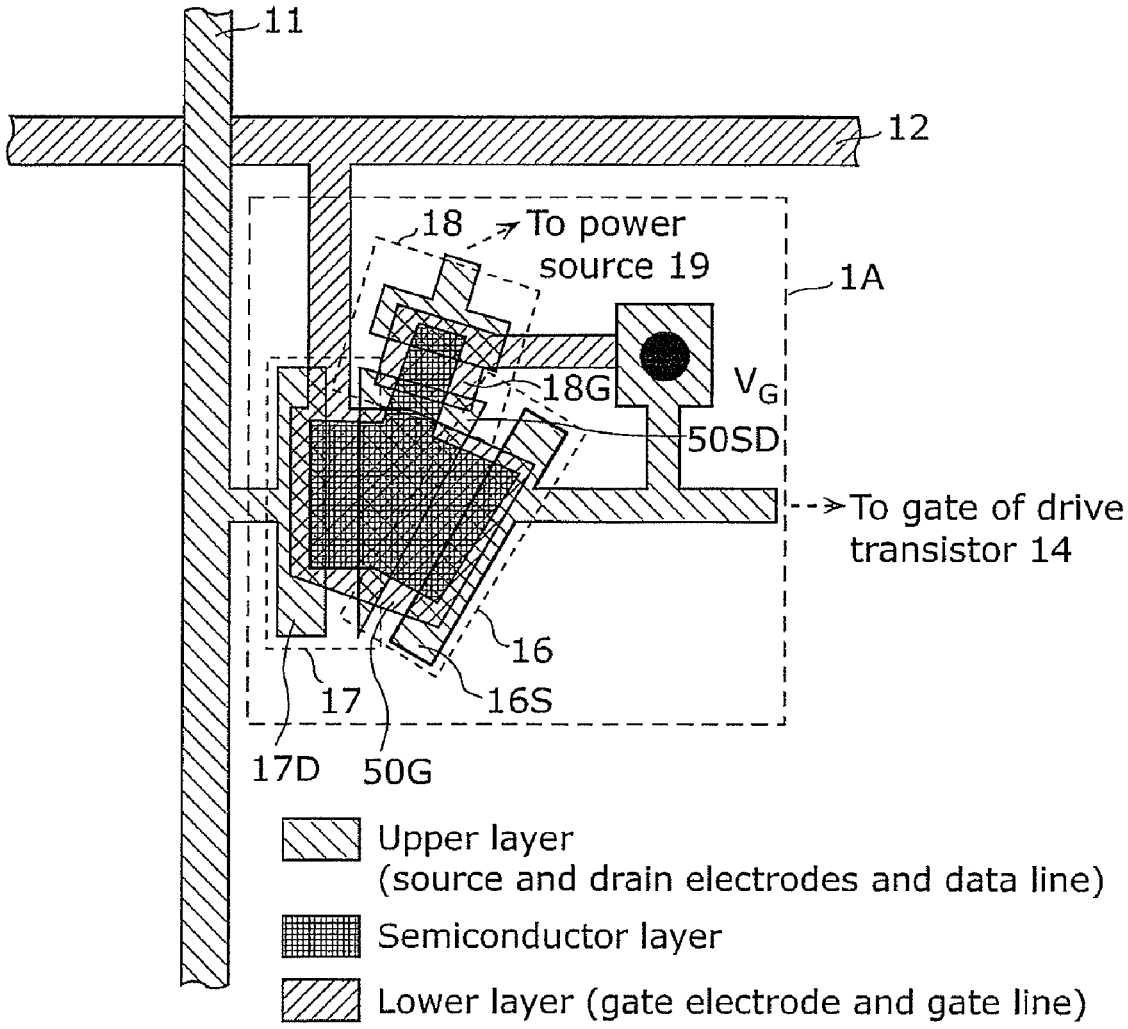
FIG. 5 is an example of a circuit layout diagram of the pixel according to the embodiment 1 of the present disclosure.

FIG. 5 is an example of a circuit layout diagram of the pixel according to the embodiment 1 of the present disclosure. The pixel 1A has two-layered structure with a drive circuit layer in which the organic EL device 13 is formed on the entire surface and a drive circuit layer in which transistors and the capacitors are formed. In FIG. 5, connections of the selector transistors 16 and 17, the guard potential transistor 18, and the connection of the transistors in the drive circuit layer of the pixel 1A are illustrated. The selector transistors 16 and 17, and the guard potential transistor 18 are bottom-gate transistors. The common gate electrode 50G for the selector transistors 16 and 17, and the gate electrode 18G of the guard potential transistor 18 configure the lower layer. The common electrode 50SD for the source electrode 16S of the selector transistor 16, the drain electrode 17D of the selector transistor 17, the drain electrode of the selector transistor 16, and the source electrode of the selector transistor 17 configure the upper layer. In addition, the semiconductor layer including the selector transistors 16 and 17, and the guard potential transistor 18 is formed between the upper layer and the lower layer. As in the layout diagram of FIG. 5, by sharing the electrodes and the semiconductor layers for the three transistors allows forming the three transistors at the yield and the cost for one transistor.

Embodiment 2

With the display device 1 according to the embodiment 1, it is possible to maintain the potential $V_G$ without reduction at the capacitor 15 when the voltage of the data line 11 is lower than the writing voltage at the time of display operation. With the display device 2 according to the variation of the embodiment 1, the potential $V_G$ at the capacitor 25 is maintained without increase when the voltage in the data line 11 is higher than the writing voltage at the time of display operation.

However, with the display devices 1 and 2 according to the embodiment 1, if the relationship between the writing voltage and the voltage in the data line 11 is reversed at the time of display operation, the current path by the guard potential transistors 18 and 28 cannot be provided, making it difficult to maintain the potential $V_G$ at the capacitors 15 and 25.

The display device according to the embodiment 2 produces the effects equivalent to the effects produced by the display device according to the embodiment 1 and solves the problem of the display device. The following shall describe the embodiment 2 of the present disclosure with reference to the drawings.

Figure 6:
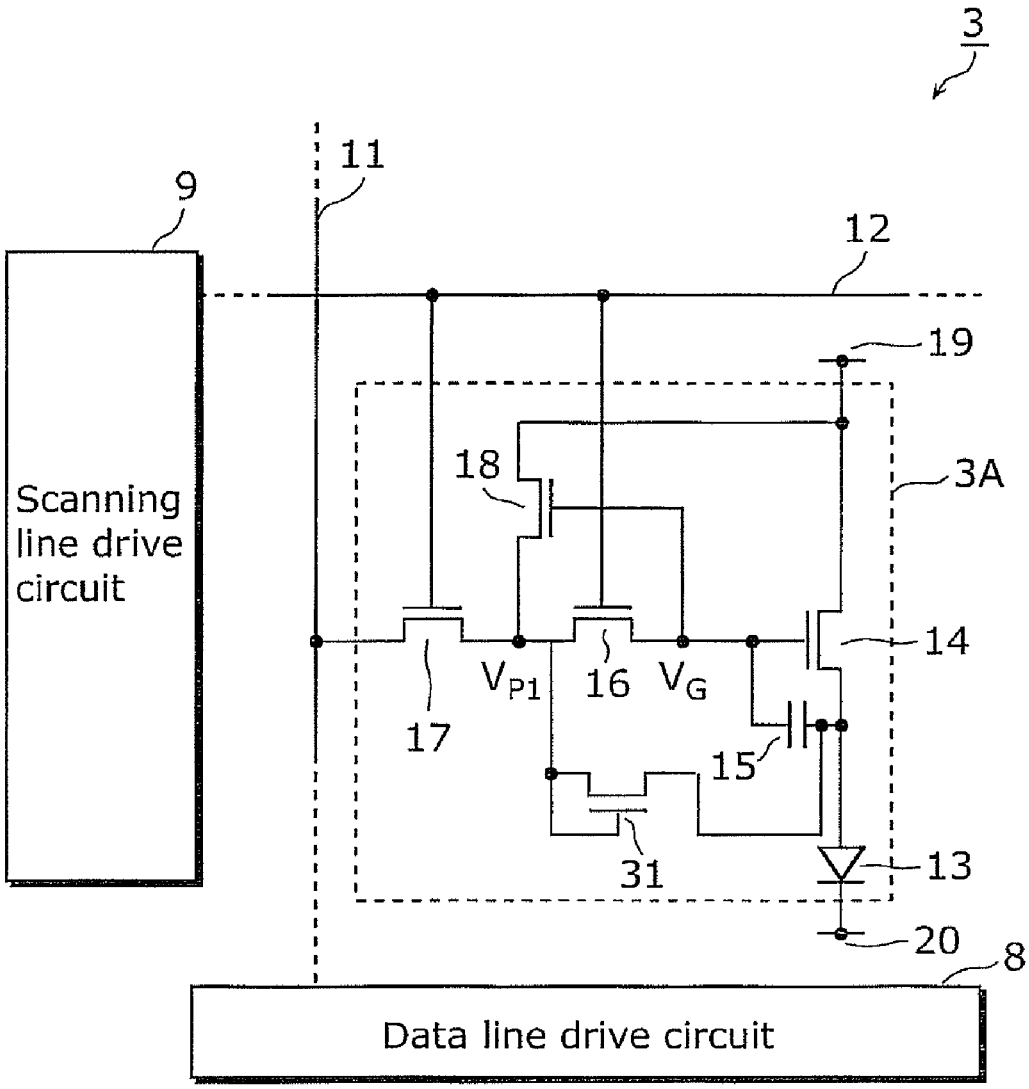
FIG. 6 is a diagram illustrating the circuit configuration of the pixel and connection with the circuits around the pixel included in the display device according to the embodiment 2 of the present disclosure.

FIG. 6 illustrates the circuit configuration of the pixel and the connection with the circuit around the pixel included in the display device according to the embodiment 2 of the present disclosure. The display device 3 illustrated in FIG. 3 includes the pixel 3A, the data line drive circuit 8, the scanning line drive circuit 9, the data line 11, the scanning line 12, and the power lines 19 and 20. In FIG. 6, only one pixel 3A is described for convenience, however, the pixels 3A are arranged in a matrix at the intersections of the scanning lines 22 and the data lines 11 and configure the display unit. The data line 11 is provided for each column of the pixels, and the scanning line 12 is provided for each row of the pixels.

The pixel 3A includes the organic EL device 13, the drive transistor 14, the capacitor 15, the selector transistors 16 and 17, the guard potential transistor 18, and a voltage variation reducing transistor 31.

The display device 3 illustrated in FIG. 6 is different from the display device 1 illustrated in FIG. 1 in that the voltage variation reducing transistor 31 is provided. In the following description, description for the components identical to those in the display device 1 shall be omitted, and the description shall be made focusing on the difference.

The voltage variation reducing transistor 31 is the fourth transistor having the gate electrode short-circuited with the drain electrode, the drain electrode connected to the other of the source electrode and the drain electrode of the selector transistor 16, and the source electrode connected to the anode electrode of the organic EL device 13. The voltage variation reducing transistor 31 is configured of an n-type thin film transistor (n-type TFT). With the connections described above, the voltage variation reducing transistor 31 is diode-connected, and a current flows from the drain electrode to the source electrode.

Accordingly, when the capacitor 15 is holding the voltage, the current for preventing the variation in the potential $V_{P1}$ at the first connecting point not only flows from the power line 19, the guard potential transistor 18, the first connecting point, the selector transistor 17, to the data line 11, but also from the data line 11, the selector transistor 17, the first connecting point, the voltage variation reducing transistor 31, to the anode electrode of the organic EL device 13. This path for the current allows maintaining the potential at the first connecting point at a constant value, regardless of the amount of the voltage in the data line 11.

Next, the function of the guard potential transistor 31 shall be described with reference to a state transition diagram of the pixel circuit.

Figure 7A:
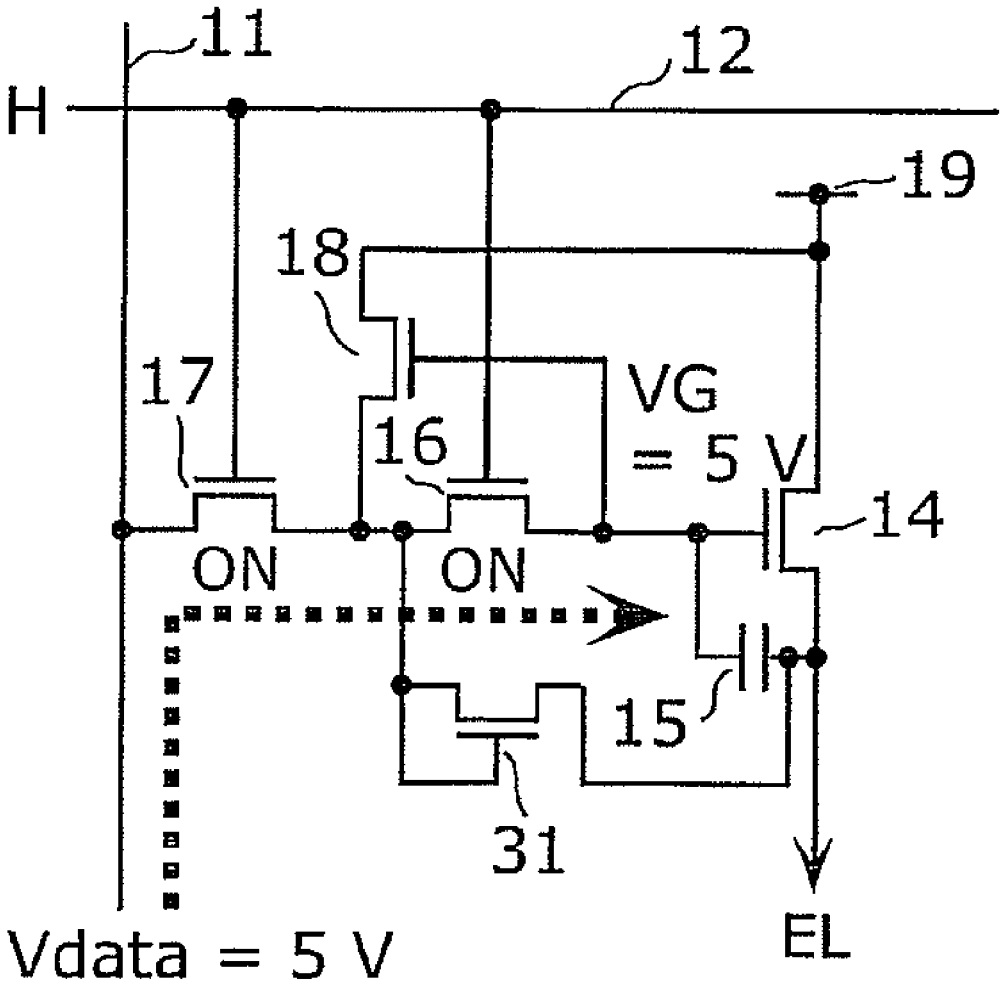
FIG. 7A is a circuit diagram illustrating a state when writing data on the pixel according to the embodiment 2 of the present disclosure.

FIG. 7A is a circuit diagram illustrating the state of the pixel according to the embodiment 2 of the present disclosure when writing data.

First, when writing data on the pixel 3A, the scanning line 12 changes to high level by the scanning line drive circuit 9, turning on the selector transistors 16 and 17. With this, the data line 11 and the capacitor connecting point are conducted. Here, the data line 11 is in the data voltage level by the data line drive circuit 8. Thus, the voltage corresponding to the data voltage is held by the capacitor 15. For example, the range of the data voltage Vdata is 0 to 10 V, and when writing data as in FIG. 7A, Vdata=5 V is written, setting $V_G$=5 V. In addition, here, the voltage of the power line 19 is set to be 10 V.

Figure 7B:
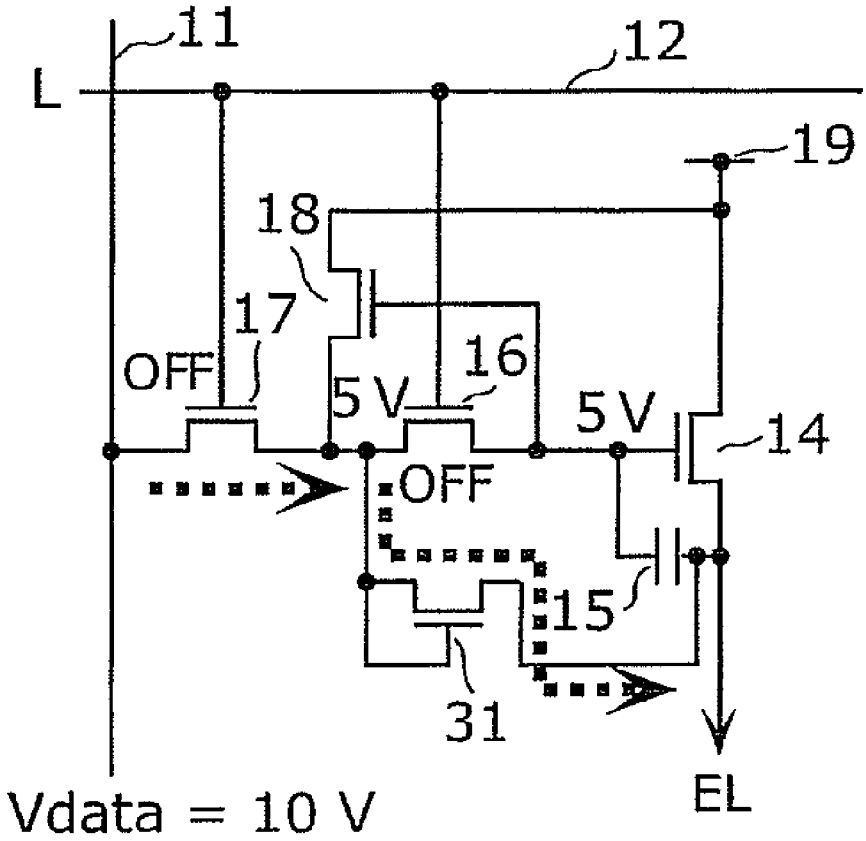
FIG. 7B is a circuit diagram illustrating a state when the pixel according to the embodiment 2 is in display operation.

FIG. 7B is a circuit diagram illustrating a state when the pixel according to the embodiment 2 is in display operation. In the display operation illustrated in FIG. 7B, the potential in the data line 11 is higher than the writing voltage. It is assumed that the voltage of the data line 11 is Vdata=10 V.

Next, when the pixel 3A is in display operation, the scanning line 12 is in low level by the scanning line drive circuit 9, turning off the selector transistors 16 and 17. Here, the off-leakage current is generated at the selector transistors 16 and 17. Here, if the voltage variation reducing transistor 31 is not provided, as in the display device 1 according to the embodiment 1, the off-leakage current flows from the data line 11, the selector transistor 17, the first connecting point, the selector transistor 16, to the connecting point for the capacitor 15, due to the relationship between the potential at the capacitor connecting point ($V_G$=5 V) and the potential of the data line 11 (Vdata=10 V). In other words, if the voltage variation reducing transistor 31 is not provided, there is no terminal for draining the off-leakage current. Consequently, the potential $V_G$ at the capacitor connecting point is not maintained at 5 V, temporally increasing from 5V.

With this, in the embodiment 2, since the voltage variation reducing transistor 31 is provided, the off-leakage current flows from the data line 11, the selector transistor 17, the first connecting point, the voltage variation reducing transistor 31, to the anode electrode of the organic EL device 13. In other words, the current flown in from the data line 11 is drained through the voltage variation reducing transistor 31 as the forward current from the voltage variation reducing transistor 31.

Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 15 to have a large area in consideration of the voltage variation due to the off-leakage current. Thus, it is possible to reduce the area of the electrodes of the capacitor compared to the conventional configuration, enabling the miniaturization of the pixels.

Figure 7C:
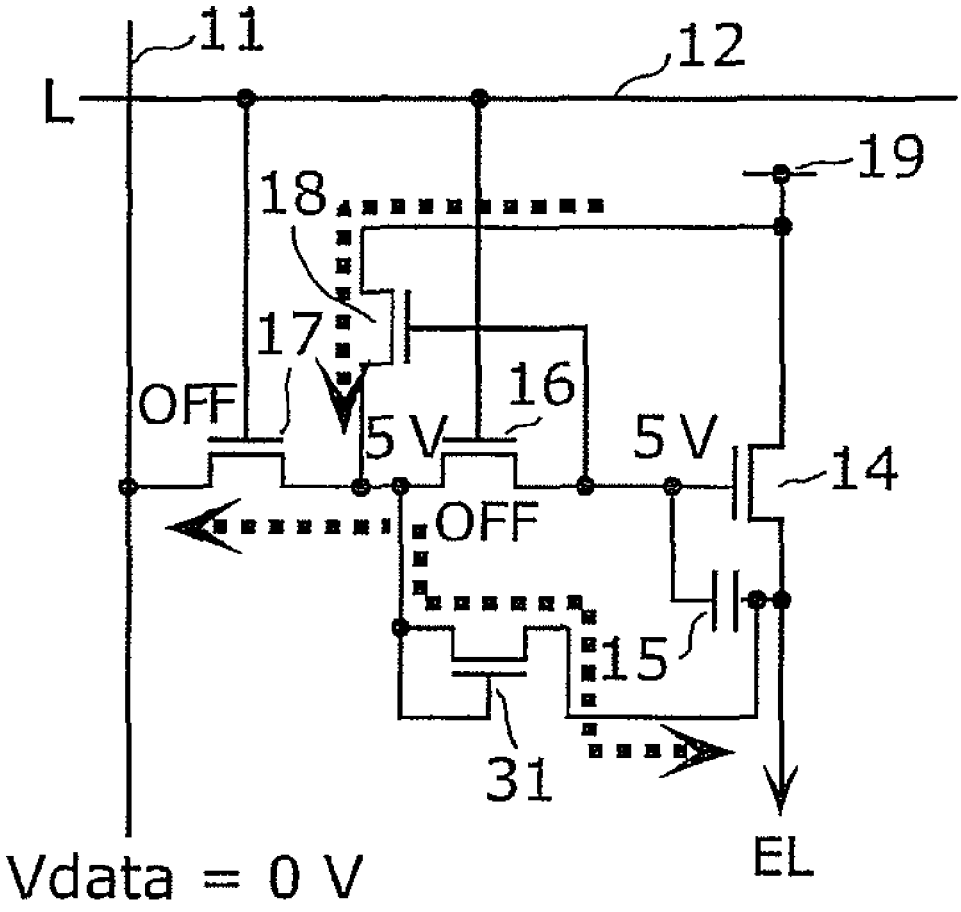
FIG. 7C is a circuit diagram illustrating a second state when the pixel according to the embodiment 2 is in display operation.

FIG. 7C is a circuit diagram illustrating a second state when the pixel according to the embodiment 2 is in display operation. In the display operation illustrated in FIG. 7C, the potential in the data line 11 is lower than the writing voltage. It is assumed that the voltage of the data line 11 is Vdata=0 V.

Next, when the pixel 3A is in display operation, the scanning line 12 is in low level by the scanning line drive circuit 9, turning off the selector transistors 16 and 17. Here, the off-leakage current is generated at the selector transistors 16 and 17. The off-leakage current flows from the first electrode of the capacitor 15, the selector transistor 16, the first connecting point, the selector transistor 17, to the data line 11, due to the relationship between the potential ($V_G$=5 V) at the capacitor connecting point and the potential (Vdata=0 V) at the data line 11.

Here, in the same manner as the display device 1 according to the embodiment 1, the potential $V_{P1}$ at the first connecting point is maintained, since the guard potential transistor 18 is provided. With the drain current from the guard potential transistor 18, the potential $V_{P1}$ at the first connecting point is restored to 5 V which is the potential before the flow of the off-leakage current, maintaining the initial potential. More specifically, the current drained to the data line 11 is restored through the guard potential transistor 18. In addition, the drain current from the guard potential transistor 18 may be split to the voltage variation reducing transistor 31.

According to the embodiment 2 described above, in the entire range of the data line voltage at the time of display operation, the potential of the first connecting point is maintained at the potential in the case where there is no off-leakage current. Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 15 to have a large area in consideration of the voltage variation due to the off-leakage current. Thus, it is possible to reduce the area of the electrodes of the capacitor compared to the conventional configuration, enabling the miniaturization of the pixels.

Note that, in the embodiment 2, the voltage variation reducing transistor 31 is connected to the anode electrode of the organic EL device 13. However, the voltage variation reducing transistor 31 may be connected to the second power line or the second fixed potential line, which is set to have a potential equal to or lower than the lowest voltage held by the capacitor 15. Note that, by not using the second fixed potential line as described in the embodiment 2, it is possible to reduce the number of fixed potential. Therefore, it is possible to simplify the circuit configuration.

Figure 8:
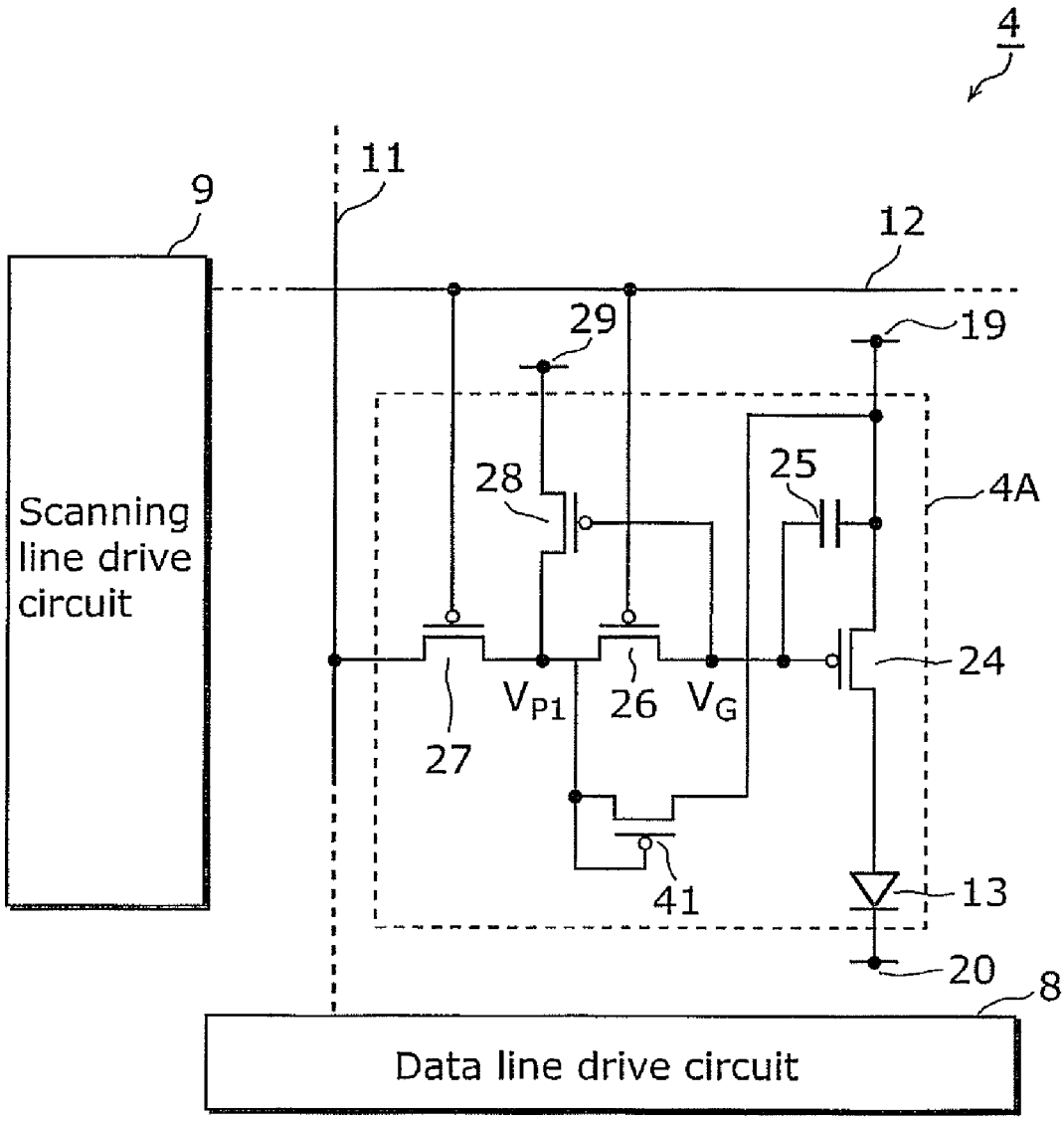
FIG. 8 is a diagram illustrating the circuit configuration of the pixel and connections with the circuits around the pixel included in the display device according to the variation of the embodiment 2 of the present disclosure.

FIG. 8 illustrates the circuit configuration of the pixel and the connections with the circuits around the pixel included in the display device according to the variation of the embodiment 2 of the present disclosure. The display device 4 illustrated in FIG. 8 includes the pixel 4A, the data line drive circuit 8, the scanning line drive circuit 9, the data line 11, the scanning line 12, the power lines 19 and 20, and a fixed potential line 29. In FIG. 8, only one pixel 4A is described for convenience, however, the pixels 4A are arranged in a matrix at the intersections of the scanning lines 12 and the data lines 11 and configure the display unit. The data line 11 is provided for each column of the pixels, and the scanning line 12 is provided for each row of the pixels.

The pixel 4A includes the organic EL device 13, the drive transistor 24, the capacitor 25, the selector transistors 26 and 27, the guard potential transistor 28, and a voltage variation reducing transistor 41.

The display device 4 illustrated in FIG. 8 is different form the display device 2 illustrated in FIG. 3 in that the voltage variation reducing transistor 41 is provided. In the following description, description for the components identical to those in the display device 2 shall be omitted, and the description shall be made focusing on the difference.

The voltage variation reducing transistor 41 is the fourth transistor which has the gate electrode short-circuited with the drain electrode, the drain electrode connected to the other of the source electrode and the drain electrode of the selector transistor 26, and the source electrode connected to the power line 19. The voltage variation reducing transistor 41 is configured of a p-type thin film transistor (p-type TFT). With the connections described above, the voltage variation reducing transistor 41 is diode-connected, and a current flows from the source electrode to the drain electrode.

With this, when the capacitor 25 is holding the voltage, the current for preventing the variation in the potential $V_{P1}$ at the first connecting point not only flows from the data line 11, the selector transistor 27, the first connecting point, the guard potential transistor 28, to the fixed potential line 29, but also from the power line 19, the voltage variation reducing transistor 41, the first connecting point, the selector transistor 27, to the data line 11. This path for the current allows maintaining the potential at the connecting point constant, regardless of the amount of the voltage in the data line 11.

Next, the function of the guard potential transistor 41 shall be described with reference to a state transition diagram of the pixel circuit.

Figure 9A:
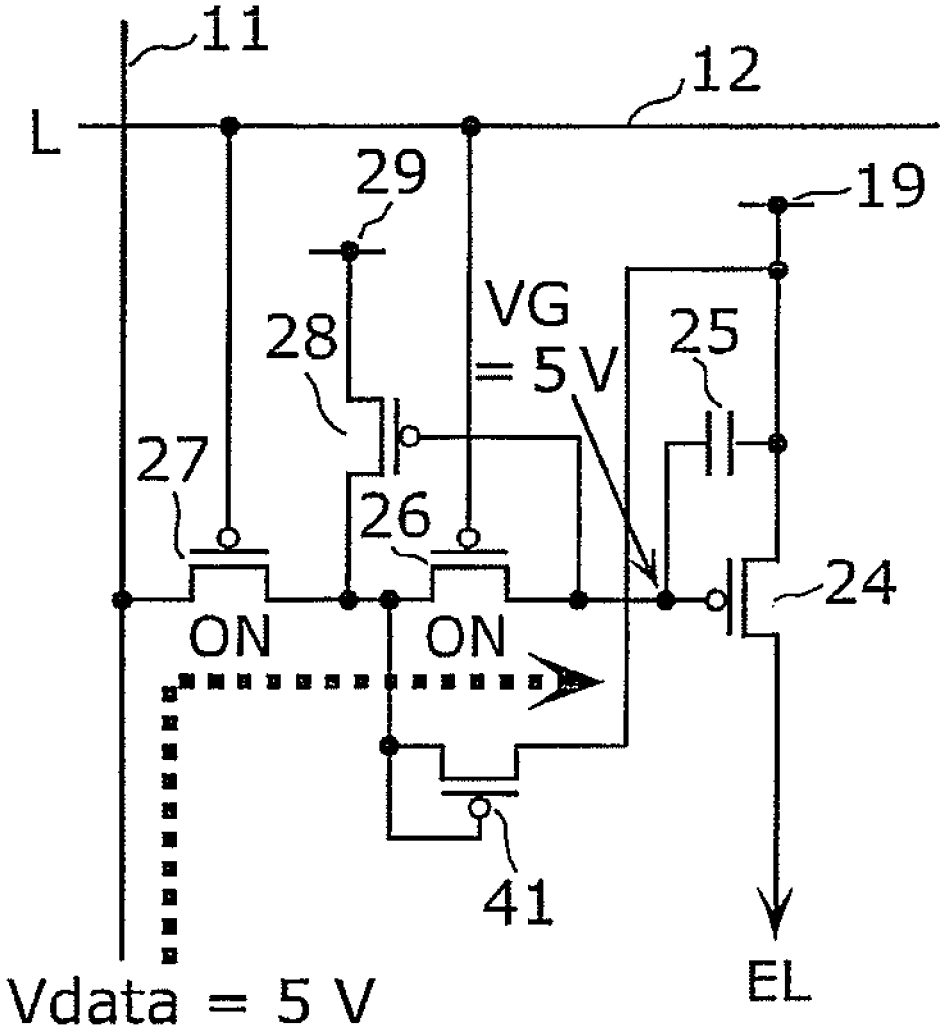
FIG. 9A is a circuit diagram illustrating a state when writing data on the pixel according to the variation in the embodiment 2 of the present disclosure.

FIG. 9A is a circuit diagram illustrating the state of the pixel according to the variation of the embodiment 2 of the present disclosure when writing data.

First, when writing data on the pixel 4A, the scanning line 12 changes to low level by the scanning line drive circuit 9, turning on the selector transistors 26 and 27. With this, the data line 11 and the capacitor connecting point are conducted. Here, the data line 11 is in the data voltage level by the data line drive circuit 8. Thus, the voltage corresponding to the data voltage is held by the capacitor 25. For example, the range of the data voltage Vdata is 0 to 10 V, and when writing data as in FIG. 9A, Vdata=5 V is written, setting $V_G$=5 V. In addition, here, the voltage of the power line 19 is set to be 10 V, and the voltage at the fixed potential line 29 is set to be 0 V.

Figure 9B:
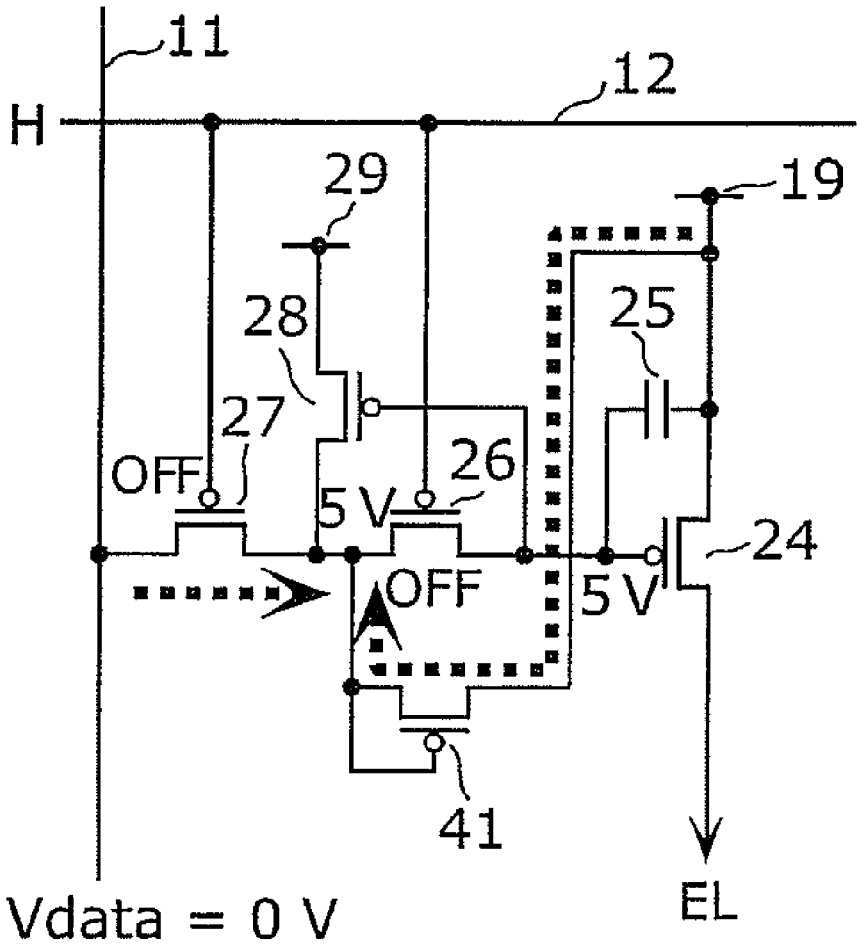
FIG. 9B is a circuit diagram illustrating a first state when the pixel according to the variation of the embodiment 2 is in display operation.

FIG. 9B is a circuit diagram illustrating a state when the pixel according to the variation of the embodiment 2 is in display operation, according to the variation in the embodiment 2 of the present disclosure. In the display operation illustrated in FIG. 9B, the potential in the data line 11 is lower than the writing voltage. It is assumed that the voltage of the data line 11 is Vdata=0 V.

When the pixel 4A is in display operation, the scanning line 12 is in high level by the scanning line drive circuit 9, turning off the selector transistors 26 and 27. Here, the off-leakage current is generated at the selector transistors 26 and 27. Here, if the voltage variation reducing transistor 41 is not provided, as in the display device 2 according to the variation of the embodiment 1, the off-leakage current flows from the capacitor connecting point, the selector transistor 26, the first connecting point, the selector transistor 27, to the data line 11, due to the relationship between the potential at the capacitor connecting point ($V_G$=5 V) and the potential of the data line 11 (Vdata=0 V). In other words, if the voltage variation reducing transistor 41 is not provided, the off-leakage current is drained to the data line 11. Consequently, the potential $V_G$ at the capacitor connecting point cannot maintain 5 V, and the potential $V_G$ temporally decreases from 5 V.

In contrast, in the embodiment 2, the current flows from the power line 19, the voltage variation reducing transistor 41, the first connecting point, the selector transistor 27, to the data line 11, since the voltage variation reducing transistor 41 is provided. Thus, the potential $V_{P1}$ at the first connecting point is maintained. By the current through the voltage variation reducing transistor 41, the potential $V_{P1}$ at the first connecting point is restored to 5 V, which is the potential before the flow of the off-leakage current, maintaining the initial potential. In other words, the current flown to the data line 11 is compensated by the forward current from the voltage variation reducing transistor 41.

Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 25 to have a large area in consideration of the voltage variation due to the off-leakage current. Thus, it is possible to reduce the area of the electrodes of the capacitor compared to the conventional configuration, enabling the miniaturization of the pixels.

Figure 9C:
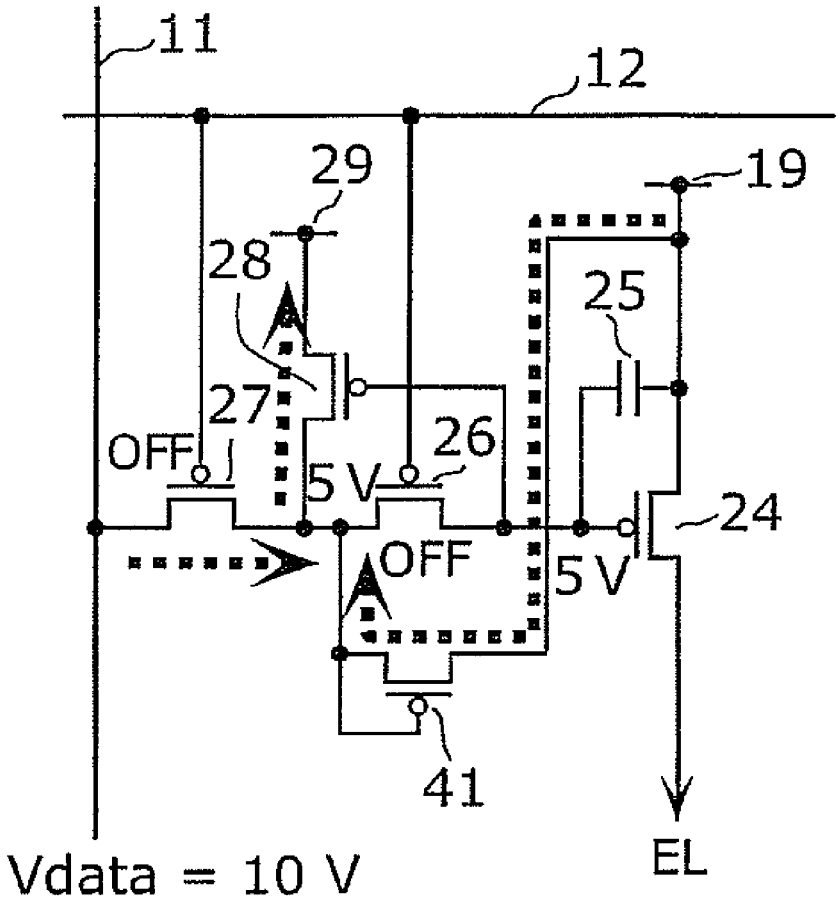
FIG. 9C is a circuit diagram illustrating a second state when the pixel according to the variation in the embodiment 2 is in display operation.

FIG. 9C is a circuit diagram illustrating a second state when the pixel according to the variation of the embodiment 2 is in display operation. In the display operation illustrated in FIG. 7B, the potential in the data line 11 is higher than the writing voltage. It is assumed that the voltage of the data line 11 is Vdata=10 V.

When the pixel 4A is in display operation, the scanning line 12 is in high level by the scanning line drive circuit 9, turning off the selector transistors 26 and 27. Here, the off-leakage current is generated at the selector transistors 26 and 27. The off-leakage current flows from the data line 11, the selector transistor 27, the first connecting point, the selector transistor 26, to the capacitor connecting point, due to the relationship between the potential at the capacitor connecting point ($V_G$=5 V) and the potential at the data line 11 (Vdata=10 V).

Here, in the same manner as the display device 2 according to the embodiment 1, the potential $V_{P1}$ at the first connecting point is maintained, since the guard potential transistor 28 is provided. With the drain current from the guard potential transistor 28, the potential $V_{P1}$ at the first connecting point is restored to 5 V which is the potential before the flow of the off-leakage current, maintaining the initial potential. In other words, the current flown from the data line 11 is drained through the guard potential transistor 28.

Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 25 to have a large area in consideration of the voltage variation due to the off-leakage current. Thus, it is possible to reduce the area of the electrodes of the capacitor compared to the conventional configuration, enabling the miniaturization of the pixels.

Note that, in the embodiment 2, the voltage variation reducing transistor 41 is connected to the power line 19. However, the voltage variation reducing transistor 41 may be connected to the fixed potential line set to be in a potential equal to or higher than the highest voltage held by the capacitor 25. Note that, by not using the fixed potential line separately provided, it is possible to reduce the number of fixed potential line. Therefore, it is possible to simplify the circuit configuration.

Embodiment 3

In the display device 3 according to the embodiment 2, a flow-through current always flows from the power line 19, the guard potential transistor 18, the first connecting point, the voltage variation reducing transistor 31, to the anode electrode of the organic EL device 13 at the time of display operation. In the display device 4 described in the embodiment 2, the flow-through current always flows from the power line 19, the voltage variation reducing transistor 41, the first connecting point, the guard potential transistor 28, to the fixed potential line 29, at the time of display operation. The flow-through current increases the power consumption.

The display device according to the embodiment 3 produces the effects equivalent to the effects produced by the display device according to the embodiment 2 and solves the problem of the display device. The following shall describe the embodiment 3 of the present disclosure with reference to the drawings.

Figure 10:
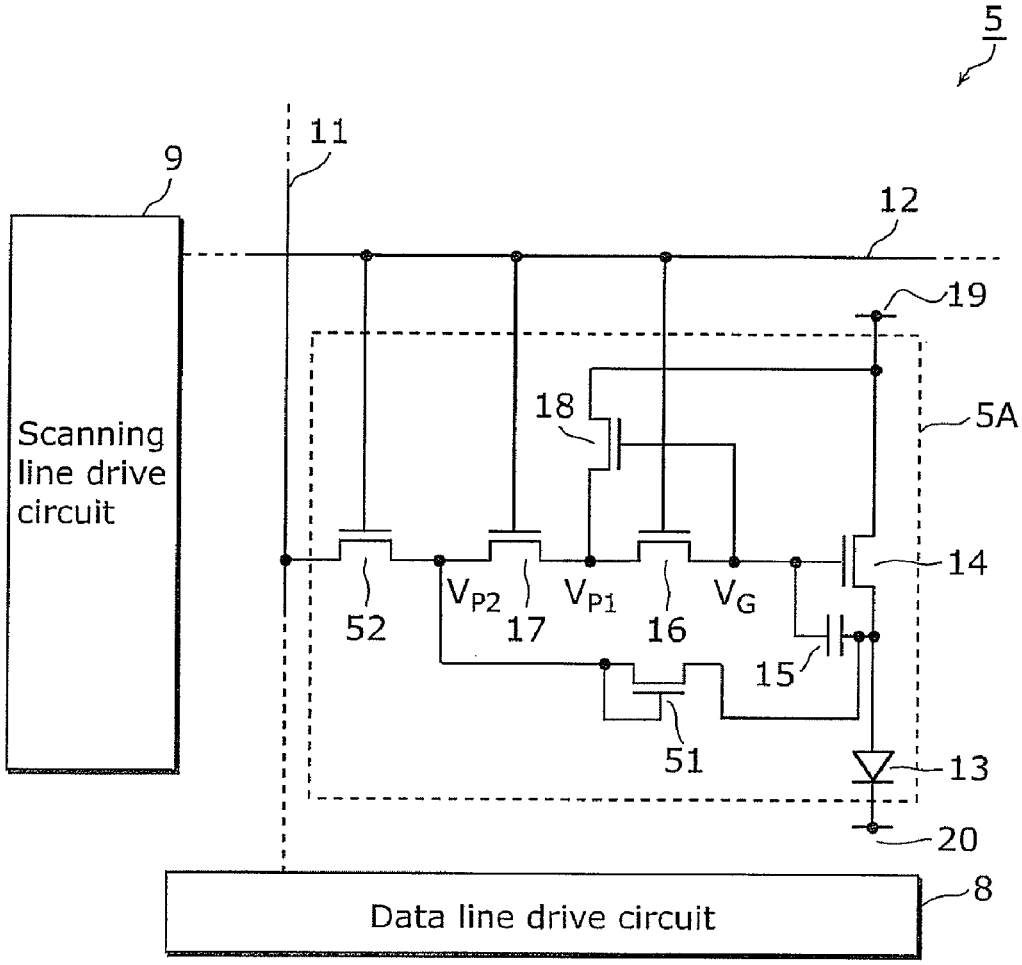
FIG. 10 is a diagram illustrating the circuit configuration of the pixel and connections with the circuits around the pixel included in the display device according to the embodiment 3 of the present disclosure.

FIG. 10 is a diagram illustrating the circuit configuration of the pixel and the connections with the circuits around the pixel included in the display device according to the embodiment 3 of the present disclosure. The display device 5 illustrated in FIG. 10 includes the pixel 5A, the data line drive circuit 8, the scanning line drive circuit 9, the data line 11, the scanning line 12, and the power lines 19 and 20. In FIG. 10, only one pixel 5A is described for convenience, however, the pixels 5A are arranged in a matrix at the intersections of the scanning lines 12 and the data lines 11 and configure the display unit. The data line 11 is provided for each column of the pixels, and the scanning line 12 is provided for each row of the pixels.

The pixel 5A includes the organic EL device 13, the drive transistor 14, the capacitor 15, the selector transistors 16, 17, and 52, the guard potential transistor 18, and the voltage variation reducing transistor 51.

The display device 5 illustrated in FIG. 10 differs from the display device 3 illustrated in FIG. 6 in that the selector transistor 52 is added, and in the connecting point of the voltage variation reducing transistor 51. In the following description, description for the components identical to those in the display device 3 shall be omitted, and the description shall be made focusing on the difference.

The selector transistor 52 is a fifth transistor having the gate electrode connected to the scanning line 12, one of the source electrode and the drain electrode connected to the other of the source electrode and the drain electrode of the selector transistor 17, and the other of the source electrode and the drain electrode connected to the data line 11, and switches between the conduction and non-conduction of the data line 11 and the pixel 5A in synchronization with the selector transistors 16 and 17 by the scanning signal from the scanning line 12. The selector transistor 52 is configured of an n-type thin film transistor (n-type TFT). In the following description, the point connecting the other of the source electrode and the drain electrode of the selector transistor 17 and one of the source electrode and the drain electrode of the selector transistor 52 is referred to as the second connecting point.

The voltage variation reducing transistor 51 is the fourth transistor having the gate electrode short-circuited with the drain electrode, the drain electrode connected to the other of the source electrode and the drain electrode of the selector transistor 17, and the source electrode connected to the anode electrode of the organic EL device 13. The voltage variation reducing transistor 51 is configured of an n-type thin film transistor (n-type TFT). With the connections described above, the voltage variation reducing transistor 51 is diode-connected, and a current flows from the drain electrode toward the source electrode.

With this, when the capacitor 15 is holding the voltage, the current for preventing the variation in the potential $V_{P1}$ at the first connecting point flows from the power line 19, the guard potential transistor 18, the first connecting point, the selector transistor 17, the second connecting point, the voltage variation reducing transistor 51, to the anode electrode of the organic EL device 13. With this path for the current, the potential $V_{P2}$ at the second connecting point during the display operation is fixed to the potential of the anode electrode of the organic EL device 13. The operation for fixing the potential at the second connecting point and the operation by the guard potential transistor 18 maintain the source-drain voltage in the selector transistor at a constant value. Accordingly, it is possible to maintain the potential $V_{P1}$ of the first connecting point at a constant value, regardless of the amount of voltage in the data line 11.

Next, the voltage stabilizing function of the pixel 5A shall be described with reference to a state transition diagram of the pixel circuit.

Figure 11A:
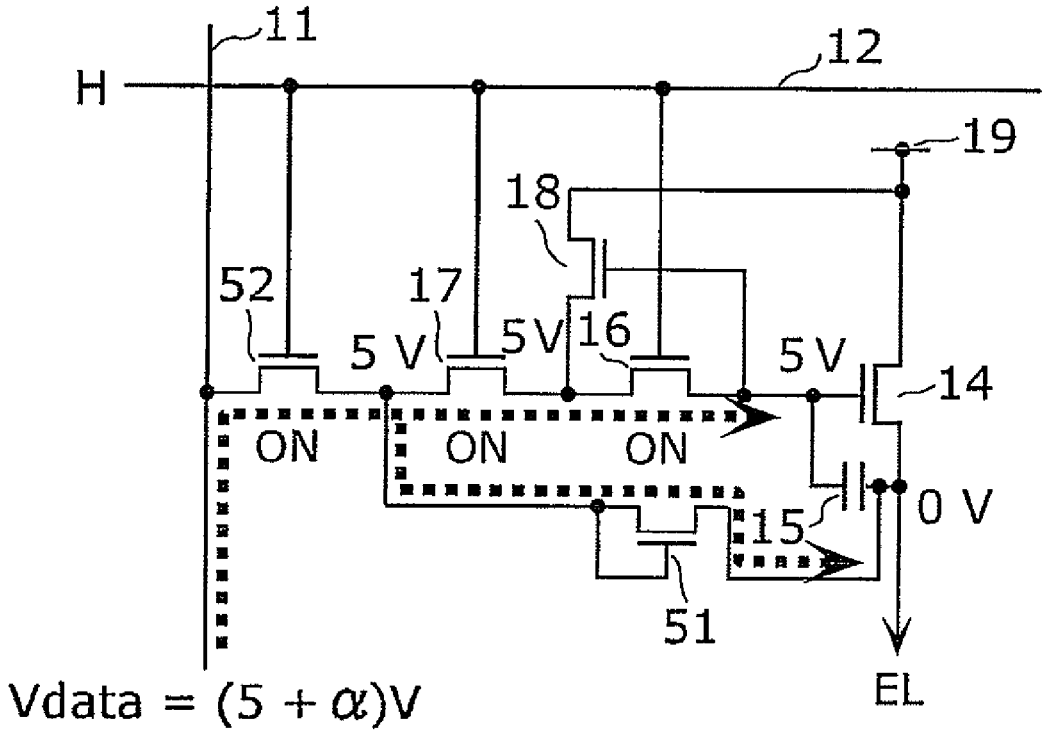
FIG. 11A is a circuit diagram illustrating a state when writing data on the pixel according to the embodiment 3 of the present disclosure.

FIG. 11A is a circuit diagram illustrating the state of the pixel according to the embodiment 3 of the present disclosure when writing data.

First, when writing data on the pixel 5A, the scanning line 12 is in high level by the scanning line drive circuit 9, turning on the selector transistors 16, 17, and 52. With this, the data line 11 and the capacitor connecting point are conducted. Here, the data line 11 is in the data voltage level by the data line drive circuit 8. Thus, the voltage corresponding to the data voltage is held by the capacitor 15. For example, the range of the data voltage Vdata is 0 to 10 V, and when writing data as in FIG. 11A, Vdata=(5+α) V is written, setting $V_G$=5 V. In addition, here, the voltage in the power line 19 is set at 10 V, and the potential at the anode electrode of the organic EL device 13 is 0 V, for example. Here, Vdata=(5+α) V in order to take voltage drop in the data voltage when writing data at a current path formed from the data line 11, the selector transistor 52, the voltage reduction transistor 51, the anode electrode of the organic EL device 13 into consideration, in addition to the current path from the data line 11 to the capacitor connecting point. Note that, the voltage variation reducing transistor 51 has a high turn-on resistance. Thus, the current passing through the voltage variation reducing transistor 51 is smaller than the current to the capacitor 15. With the relationship of the current path, approximately 0.5 is set as α, for example.

Figure 11B:
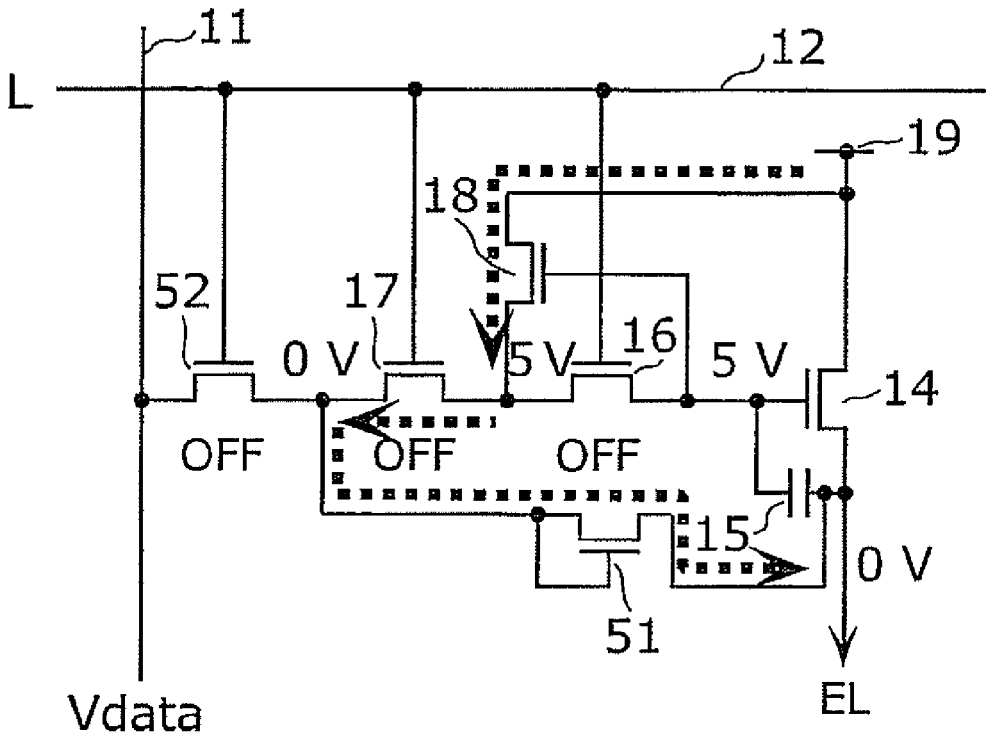
FIG. 11B is a circuit diagram illustrating a state when the pixel according to the embodiment 3 is in display operation.

FIG. 11B is a circuit diagram illustrating a state when the pixel according to the embodiment 3 is in display operation. The display operation illustrated in FIG. 11B represents a state of the circuit irrelevant to the relationship between the values of the voltage at the data line 11 and the writing voltage.

Next, when the pixel 5A is in display operation, the scanning line 12 is in low level by the scanning line drive circuit 9, turning off the selector transistors 16, 17 and 52. Here, the off-leakage current may be generated at the selector transistors 16, 17, and 52.

In the pixel 5A according to the embodiment 3, the voltage variation reducing transistor 51 is connected to the second connecting point and the anode electrode of the organic EL device 13. Thus, the potential at the second connecting point is 0 V, which is the potential at the anode electrode of the organic EL device 13.

In this state, if the second connecting point is equivalent to the data line 11 in the pixel 1A illustrated in FIG. 2B, the state of the circuit at the time of the display operation of the pixel 5A is identical to the circuit state described in FIG. 2B, at the time of display operation of the pixel 1A according to the embodiment 1. First, the off-leakage current causes a potential difference between the source and the drain of the selector transistor 16. Next, since the potential difference is also the gate-source voltage at the guard potential transistor 18, the drain current corresponding to the gate-source voltage flows in the guard potential transistor 18 from the power line 19, the guard potential transistor 18, the first connecting point, the selector transistor 17, the second connecting point, the voltage variation reducing transistor 51, to the anode electrode of the organic EL device 13. With the drain current from the guard potential transistor 18, the potential $V_{P1}$ at the first connecting point is restored to 5 V which is the potential before the flow of the off-leakage current, maintaining the initial potential.

According to the embodiment 3, regardless of the relationship between the data line voltage and the writing voltage, the potential $V_{P1}$ at the first connecting point is maintained at the potential when there is no off-leakage potential. Accordingly, the potential $V_G$ at the capacitor 15 does not change, and the voltage corresponding to the accurate data voltage is held. With this, the organic EL device 13 can emit light at a desired luminance. In addition, it is not necessary to design the electrodes of the capacitor 15 to have a large area in consideration of the voltage variation due to the off-leakage current. Thus, it is possible to reduce the area of the electrodes of the capacitor compared to the conventional configuration, enabling the miniaturization of the pixels.

Furthermore, since the guard potential transistor 18 and the voltage variation reducing transistor 51 are connected through the selector transistor 17, a source-drain resistance of the selector transistor 17 exists in the current path from the power line 19 to the anode electrode of the organic EL device 13 when the selector transistor 17 is turned off. With this, the current path is not the flow-through current as in the display device 3 according to the embodiment 2, reducing the power consumption.

Note that, in the embodiment 2, the voltage variation reducing transistor 51 is connected to the anode electrode of the organic EL device 13. However, the voltage variation reducing transistor 31 may be connected to the second power line or the second fixed potential line which is set to have a potential equal to or lower than the lowest voltage held by the capacitor 15. Note that, by not using the second fixed potential line as in the embodiment 3, it is possible to reduce the number of fixed potential line. Therefore, it is possible to simplify the circuit configuration.

Figure 12:
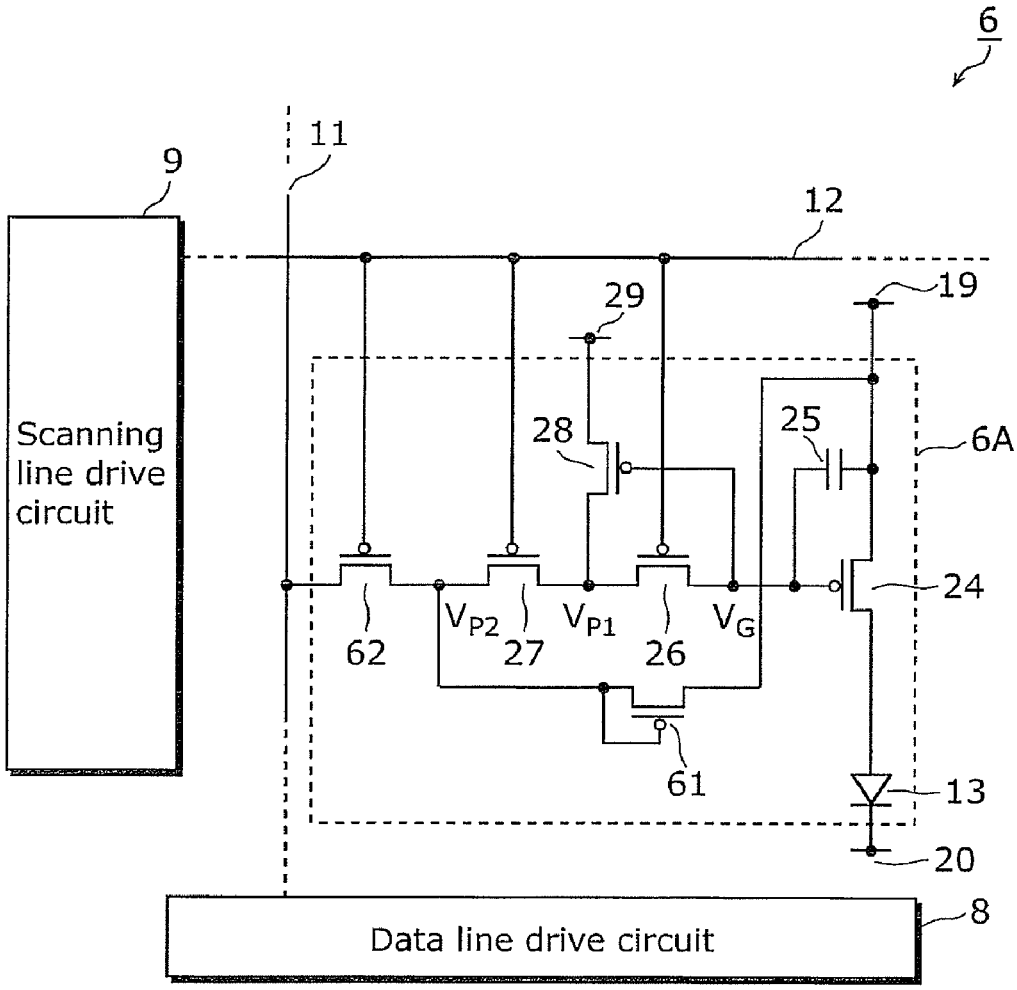
FIG. 12 is a diagram illustrating the circuit configuration of the pixel and connections with the circuits around the pixel included in the display device according to the variation of the embodiment 3 of the present disclosure.

FIG. 12 is a diagram illustrating the circuit configuration of the pixel and the connections with circuits around the pixel included in the display device according to the variation of the embodiment 3 of the present disclosure. The display device 6 illustrated in FIG. 12 includes the pixel 6A, the data line drive circuit 8, the scanning line drive circuit 9, the data line 11, the scanning line 12, the power lines 19 and 20, and a fixed potential line 29. In FIG. 12, only one pixel 6A is described for convenience, however, the pixels 6A are arranged in a matrix at the intersections of the scanning lines 12 and the data lines 11 and configure the display unit. The data line 11 is provided for each column of the pixels, and the scanning line 12 is provided for each row of the pixels.

The pixel 6A includes the organic EL device 13, the drive transistor 24, the capacitor 25, the selector transistors 26, 27, and 62, the guard potential transistor 28, and the voltage variation reducing transistor 61. The display device 6 illustrated in FIG. 12 differs from the display device 4 illustrated in FIG. 8 in that the selector transistor 62 is added, and in the connecting point of the voltage variation reducing transistor 61. In the following description, description for the components identical to those in the display device 4 shall be omitted, and the description shall be made focusing on the difference.

The selector transistor 62 is a fifth transistor having the gate electrode connected to the scanning line 12, one of the source electrode and the drain electrode connected to the other of the source electrode and the drain electrode of the selector transistor 27, and the other of the source electrode and the drain electrode connected to the data line 11, and switches between the conduction and non-conduction of the data line 11 and the pixel 6A in synchronization with the selector transistors 26 and 27 by the scanning signal from the scanning line 12. The selector transistor 62 is configured of a p-type thin film transistor (p-type TFT).

The voltage variation reducing transistor 61 is the fourth transistor which has the gate electrode short-circuited with the drain electrode, the drain electrode connected to the other of the source electrode and the drain electrode of the selector transistor 27, and the source electrode connected to the power line 19. The voltage variation reducing transistor 61 is configured of a p-type thin film transistor (p-type TFT). With the connections described above, the voltage variation reducing transistor 61 is diode-connected, and a current flows from the source electrode to the drain electrode.

With this, when the capacitor 25 holds voltage, the current for preventing the variation in the potential $V_{P1}$ at the first connecting point not only flows from the power line 19, the voltage variation reduction transistor 61, the second connecting point, the selector transistor 27, the first connecting point, the guard potential transistor 28, to the fixed potential line 29. With the current path, the potential $V_{P2}$ at the second connecting point during the display operation is fixed to the potential of the power line 19. This and the operation by the guard potential transistor 28 maintain the source-drain voltage in the selector transistor 27 at a constant value. Accordingly, it is possible to maintain the potential $V_{P1}$ of the first connecting point at a constant value, regardless of the amount of voltage in the data line 11.

Next, the voltage stabilizing function of the pixel 6A shall be described with reference to a state transition diagram of the pixel circuit.

Figure 13A:
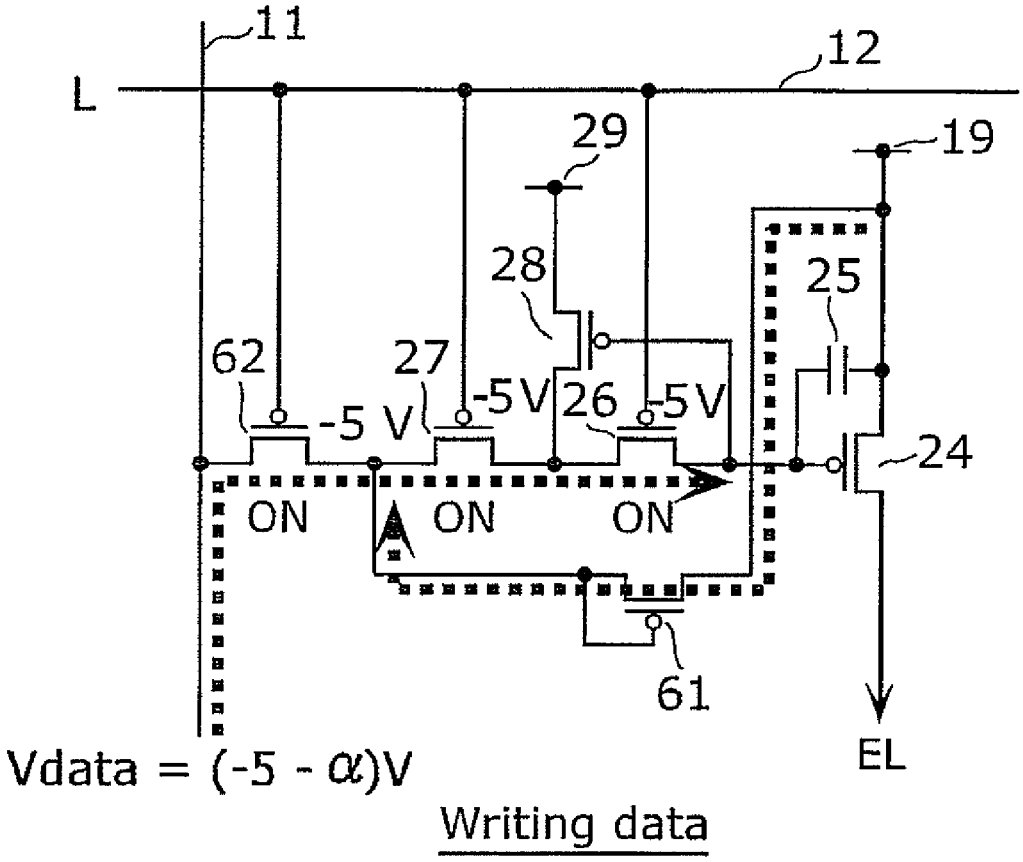
FIG. 13A is a circuit diagram illustrating a state when writing data on the pixel according to the variation in the embodiment 3 of the present disclosure.

FIG. 13A is a circuit diagram illustrating a state when writing data on the pixel according to the variation in the embodiment 3 of the present disclosure.

First, when writing data on the pixel 6A, the scanning line 12 is in low level by the scanning line drive circuit 9, turning on the selector transistors 26, 27, and 62. With this, the data line 11 and the capacitor connecting point are conducted. Here, the data line 11 is in the data voltage level by the data line drive circuit 8. Thus, the voltage corresponding to the data voltage is held by the capacitor 25. For example, the range of the data voltage Vdata is 0 to −10 V, and when writing data as in FIG. 13A, Vdata=(−5−α) V is written, setting VG=−5 V. Here, the voltage of the power line 19 is set at 10 V, and the potential of the fixed potential line 29 is −10 V, for example. Here, Vdata=(−5−α) V in order to take voltage increase in the data voltage at a current path formed from the power line 19, the voltage variation reduction transistor 61, to the selector transistor 27 into consideration, in addition to the current path from the data line 11 to the capacitor connecting point when writing data. Note that, the voltage variation reducing transistor 61 has a high turn-on resistance. Thus, the current passing through the voltage variation reducing transistor 61 is smaller than the current to the capacitor connecting point. With the relationship of the current paths, approximately 0.5 is set as α, for example.

Figure 13B:
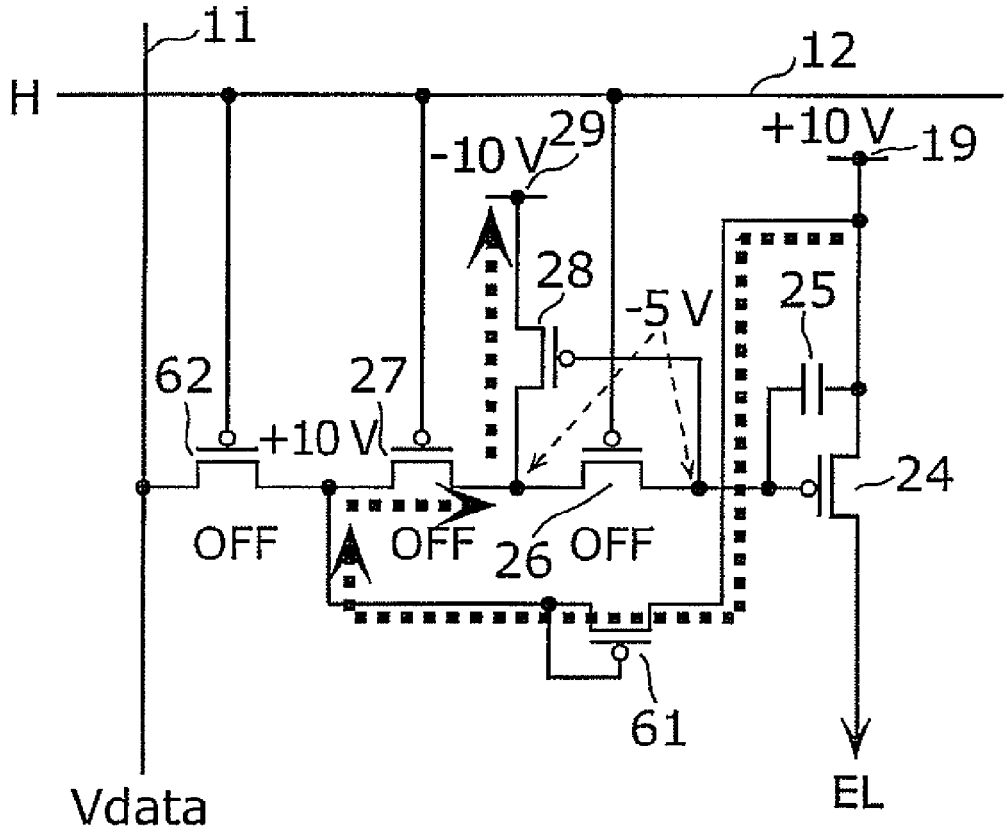
FIG. 13B is a circuit diagram illustrating a state when the pixel according to the variation in the embodiment 3 is in display operation.

FIG. 13B is a circuit diagram illustrating a state when the pixel according to the variation in the embodiment 3 is in display operation. The display operation illustrated in FIG. 13B represents a state of the circuit irrelevant to the relationship between the values of the voltage at the data line 11 and the writing voltage.

Next, when the pixel 6A is in display operation, the scanning line 12 is in high level by the scanning line drive circuit 9, turning off the selector transistors 26, 27, and 62. Here, the off-leakage current may be generated at the selector transistors 26, 27, and 62.

In the pixel 6A according to the embodiment 3, the voltage variation reducing transistor 61 is connected to the second connecting point and the power line 19. Thus, the potential at the second connecting point is 10 V, which is the potential in the power line 19.

In this state, if the second connecting point is considered to be equivalent to the data line 11 in the pixel 2A illustrated in FIG. 4B, the state of the circuit at the time of the display operation of the pixel 6A, is identical to the circuit state at the time of the display operation of the pixel 2A according to the embodiment 1. First, the off-leakage current causes a potential difference between the source and the drain of the selector transistor 26. Next, since the potential difference is the gate-source voltage at the guard potential transistor 28, the drain current corresponding to the gate-source voltage flows in the guard potential transistor 28 from the power line 19, the voltage variation reducing transistor 61, the second connecting point, the selector transistor 27, the first connecting point, the guard potential transistor 28, to the fixed potential line 29. With the drain current from the guard potential transistor 28, the potential $V_{P1}$ at the first connecting point is restored to −5 V which is the potential before the flow of the off-leakage current, maintaining the initial potential.

According to the embodiment 3, regardless of the relationship between the data line voltage and the writing voltage, the potential $V_{P1}$ at the first connecting point is maintained at the potential when there is no off-leakage current. Accordingly, the potential $V_G$ at the capacitor connecting point does not change, and the voltage according to the precise data voltage can be held. Thus, it is possible to cause the organic EL device 13 to emit light at a desired luminance. In addition, it is not necessary to design the electrodes of the capacitor 25 to have a large area in consideration of the voltage variation due to the off-leakage current. Thus, it is possible to reduce the area of the electrodes of the capacitor compared to the conventional configuration, enabling the miniaturization of the pixels.

Furthermore, since the guard potential transistor 18 and the voltage variation reduction transistor 61 are connected via the selector transistor 27, the source-drain resistance of the selector transistor 27 is interposed in the current path described above from the power line 19 to the fixed potential line 29 when the selector transistor 27 is turned off. With this, the current path does not cause a large flow-through current as in the display device 4 according to the embodiment 2, reducing the power consumption.

Note that, in the embodiment 3, the voltage variation reducing transistor 61 is connected to the power line 19. However, the voltage variation reducing transistor 61 may be connected to the fixed potential line set to be in a potential equal to or higher than the highest voltage held by the capacitor 25. Note that, by not using the second fixed potential line separately, it is possible to reduce the number of fixed potential line. Therefore, it is possible to simplify the circuit configuration.

Although only the embodiments 1 to 3 of the present disclosure have been described in detail above, those skilled in the art will readily appreciate that many modifications are possible in the embodiments 1 to 3 without materially departing from the novel teachings and advantages of the present disclosure. Accordingly, all such modifications and devices incorporating the display device according to the present disclosure are intended to be included within the scope of the present disclosure.

Note that, the pixel circuit included in the display device according to the present disclosure may not be limited to the pixel circuit described as the embodiments 1 to 3 and the variations of the embodiments. In addition to the pixel circuits described above, a display device including a pixel circuit in which a switching transistor for controlling the light-emission period is inserted between the power line 19 and the power line 20 is also included in the present disclosure.

Figure 14:
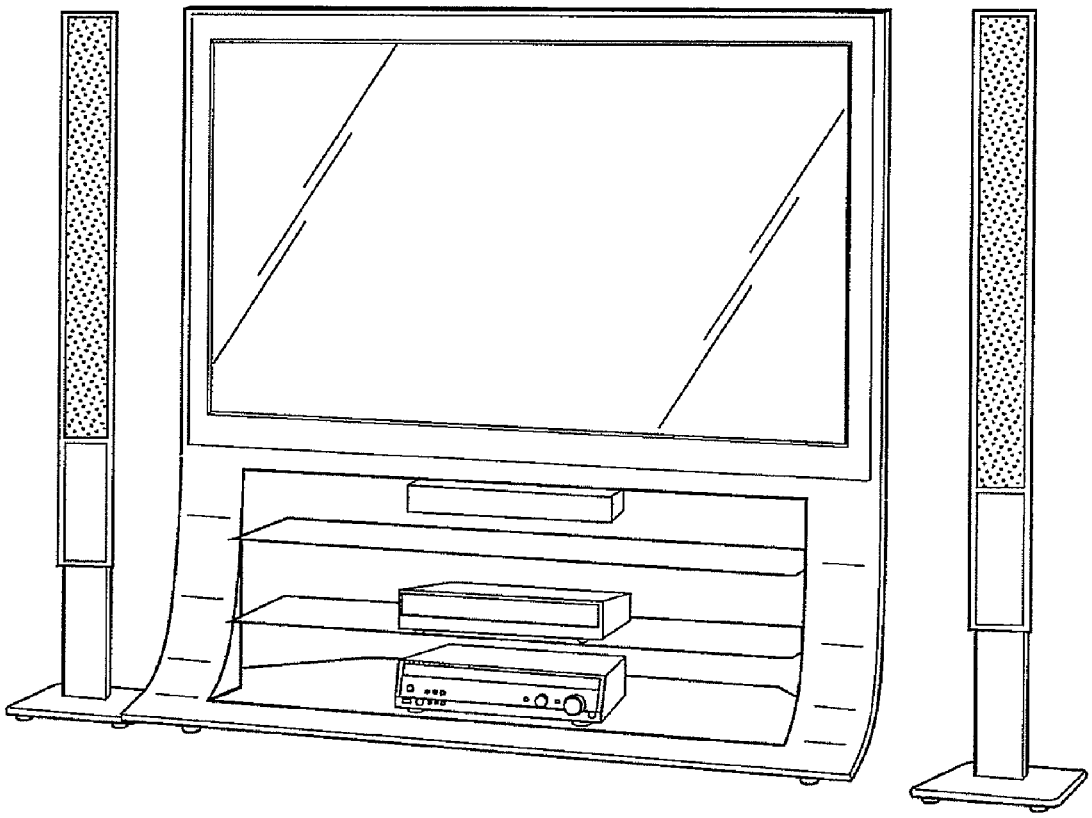
FIG. 14 is a diagram illustrating the appearance of a thin flat TV in which the display device according to the present disclosure is incorporated.
Figure 15:
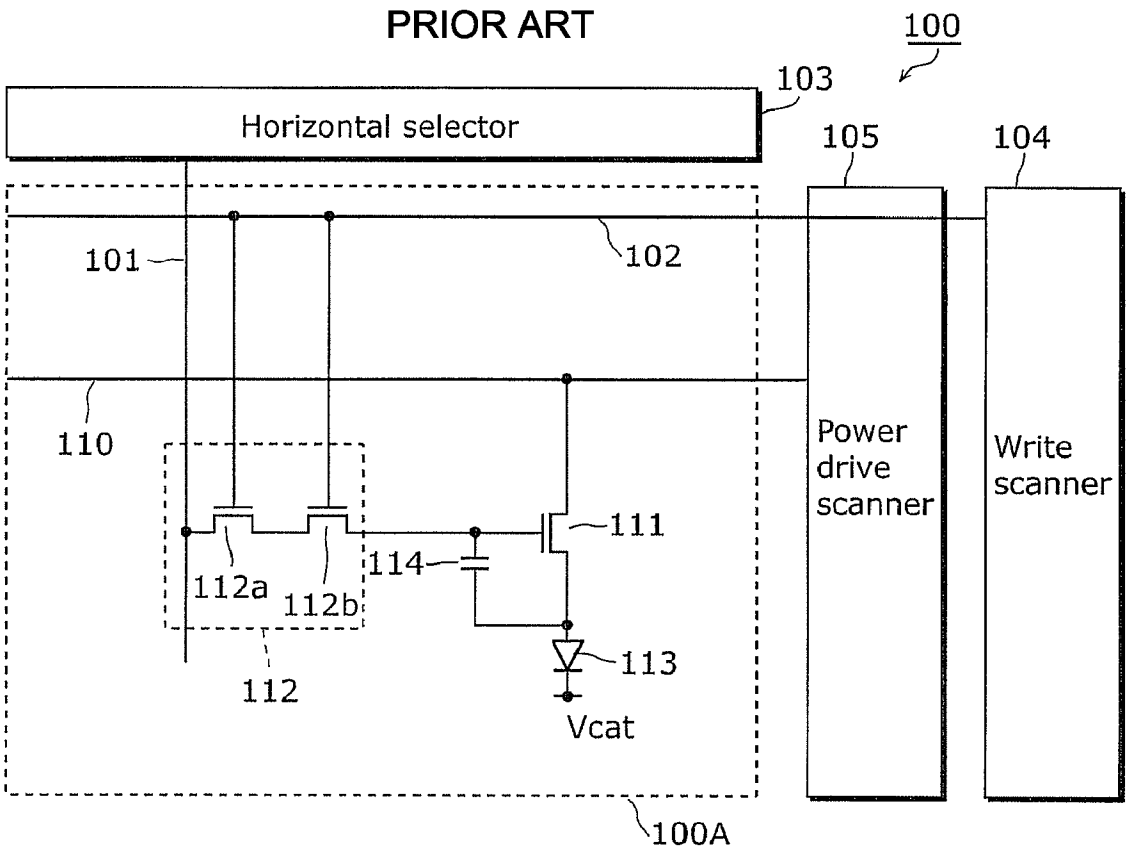
FIG. 15 PRIOR ART
FIG. 15 is a diagram illustrating the circuit configuration of the pixel and connections with the circuits around the pixel included in the display device disclosed in the patent literature 1.

In addition, for example, the display device according to the present disclosure is incorporated in a thin flat television illustrated in FIG. 14. By incorporating the display device according to the present disclose implements a thin flat television capable of displaying high-definition images reflecting the video signal.

INDUSTRIAL APPLICABILITY

The present disclosure is applicable to an active organic EL flat-panel display in which the luminance is changed by controlling the light-emission intensity of the pixel by the pixel signal current.

The invention claimed is:

1. A display device comprising:

a plurality of scanning lines;

a plurality of data lines;

a plurality of pixels each provided at an intersection of one of the scanning lines and one of the data lines; and a power line for supplying current to the pixels, wherein each of the pixels includes:

a light-emitting device which emits light according to a flow of a drive current corresponding to a data voltage supplied through one of the data lines;

a drive transistor which is connected between the power line and the light-emitting device and which converts the data voltage into the drive current, according to a voltage applied to a gate electrode;

a capacitor which has one electrode connected to the gate electrode of the drive transistor and which holds a voltage according to the data voltage;

a first transistor having a gate electrode connected to one of the scanning lines and one of a source electrode and a drain electrode connected to the gate electrode of the drive transistor;

a second transistor having a gate electrode connected to the one of the scanning line lines, one of a source electrode and a drain electrode connected to the other of the source electrode and the drain electrode of the first transistor, and the other of the source electrode and the drain electrode connected to the one of the data line lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the first transistor, and a source electrode connected to a second potential line, wherein:

the fourth transistor is an n-type transistor, and the second potential line is a second power line having a potential, with respect to a reference potential, set to be equal to or lower than a lowest voltage held by the capacitor.

2. The display device according to claim 1, wherein the drive transistor, the first transistor, the second transistor, and the third transistor are n-type transistors, and the first potential line is the power line having a potential, with respect to a reference potential, set to be equal to or higher than a highest voltage held by the capacitor.

3. The display device according to claim 1, wherein the drive transistor, the first transistor, the second transistor, and the third transistor are p-type transistors, and the first potential line is the one of the scanning line lines.

4. The display device according to claim 1, wherein the second potential line is connected to an anode electrode of the light-emitting device.

5. A display device comprising:

a plurality of scanning lines;

a plurality of data lines;

a plurality of pixels each provided at an intersection of one of the scanning lines and one of the data lines; and a power line for supplying current to the pixels, wherein each of the pixels includes:

a light-emitting device which emits light according to a flow of a drive current corresponding to a data voltage supplied through one of the data lines;

a drive transistor which is connected between the power line and the light-emitting device and which converts the data voltage into the drive current, according to a voltage applied to a gate electrode;

a capacitor which has one electrode connected to the gate electrode of the drive transistor and which holds a voltage according to the data voltage;

a first transistor having a gate electrode connected to one of the scanning lines and one of a source electrode and a drain electrode connected to the gate electrode of the drive transistor;

a second transistor having a gate electrode connected to the one of the scanning lines, one of a source electrode and a drain electrode connected to the other of the source electrode and the drain electrode of the first transistor, and the other of the source electrode and the drain electrode connected to the one of the data lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the first transistor, and a source electrode connected to a second potential line, wherein the fourth transistor is a p-type transistor, and the second potential line is the power line having a potential, with respect to a reference potential, set to be equal to or higher than a highest voltage held by the capacitor.

6. A display device comprising:

a plurality of scanning lines;

a plurality of data lines;

a plurality of pixels each provided at an intersection of one of the scanning lines and one of the data lines; and a power line for supplying current to the pixels, wherein each of said pixels includes:

a light-emitting device which emits light according to a flow of a drive current corresponding to a data voltage;

a drive transistor which is connected between the power line and the light-emitting device and which converts the data voltage into the drive current, according to a voltage applied to a gate electrode;

a capacitor which has one electrode connected to the gate electrode of the drive transistor and which holds a voltage according to the data voltage;

a first transistor having a gate electrode connected to one of the scanning lines and one of a source electrode and a drain electrode connected to the gate electrode of the drive transistor;

a second transistor having a gate electrode connected to the one of the scanning line lines, and one of a source electrode and a drain electrode connected to the other of the source electrode and the drain electrode of the first transistor;

a fifth transistor having a gate electrode connected to the one of the scanning line lines, one of a source electrode and a drain electrode connected to the other of the source electrode and the drain electrode of the second transistor, and the other of the source electrode and the drain electrode connected to the one of the data lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the second transistor, and a source electrode connected to a second potential line, wherein:

the drive transistor, the first transistor, the second transistor, the third transistor, the fourth transistor, and the fifth transistor are n-type transistors, the first potential line is the power line having a potential, with respect to a reference potential, set to be equal to or higher than a highest voltage held by the capacitor, and the second potential line is a second power line having a potential, with respect to the reference potential, set to be equal to or lower than a lowest voltage held by the capacitor.

7. A display device comprising:

a plurality of scanning lines;

a plurality of data lines;

a plurality of pixels each provided at an intersection of one of the scanning lines and one of the data lines; and a power line for supplying current to the pixels, wherein each of said pixels includes:

a light-emitting device which emits light according to a flow of a drive current corresponding to a data voltage:

a drive transistor which is connected between the power line and the light-emitting device and which converts the data voltage into the drive current, according to a voltage applied to a gate electrode;

a capacitor which has one electrode connected to the ate electrode of the drive transistor and which holds a voltage according to the data voltage;

a first transistor having mate electrode connected to one of the scanning lines and one of a source electrode and a drain electrode connected to the ate electrode of the drive transistor;

a second transistor having a gate electrode connected to the one of the scanning lines, and one of a source electrode and a drain electrode connected to the other of the source electrode and the drain electrode of the first transistor;

a fifth transistor having a gate electrode connected to the one of the scanning lines, one of a source electrode and a drain electrode connected to the other of the source electrode and the drain electrode of the second transistor, and the other of the source electrode and the drain electrode connected to the one of the data lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the second transistor, and a source electrode connected to a second potential line, wherein:

the drive transistor, the first transistor, the second transistor, the third transistor, the fourth transistor, and the fifth transistor are p-type transistors, the first potential line is the one of the scanning lines, and the second potential line is the power line having a potential, with respect to the reference potential, set to be equal to or higher than a highest voltage held by the capacitor.

8. A display device comprising:

a plurality of scanning lines;

a plurality of data lines;

a plurality of pixels each provided at an intersection of one of the scanning lines and one of the data lines; and a power line for supplying current to the pixels, wherein each of the pixels includes:

a light-emitting device which emits light according to a flow of a drive current corresponding to a data voltage supplied through one of the data lines;

a drive transistor which is connected between the power line and the light-emitting device and which converts the data voltage into the drive current, according to a voltage applied to a gate electrode;

a capacitor which has one electrode connected to the gate electrode of the drive transistor and which holds a voltage according to the data voltage;

a first transistor having a gate electrode connected to one of the scanning lines and one of a source electrode and a drain electrode connected to the gate electrode of the drive transistor;

a second transistor having a gate electrode connected to the one of the scanning lines, one of a source electrode and a drain electrode directly connected to the other of the source electrode and the drain electrode of the first transistor, and the other of the source electrode and the drain electrode connected to the one of the data lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the first transistor, and a source electrode connected to a second potential line.

9. A display device comprising:

a plurality of scanning lines;

a plurality of data lines;

a plurality of pixels each provided at an intersection of one of the scanning lines and one of the data lines; and a power line for supplying current to the pixels, wherein each of said pixels includes:

a light-emitting device which emits light according to a flow of a drive current corresponding to a data voltage;

a drive transistor which is connected between the power line and the light-emitting device and which converts the data voltage into the drive current, according to a voltage applied to a gate electrode;

a capacitor which has one electrode connected to the gate electrode of the drive transistor and which holds a voltage according to the data voltage;

a first transistor having a gate electrode connected to one of the scanning lines and one of a source electrode and a drain electrode connected to the gate electrode of the drive transistor;

a second transistor having a gate electrode connected to the one of the scanning lines, and one of a source electrode and a drain electrode directly connected to the other of the source electrode and the drain electrode of the first transistor;

a fifth transistor having a gate electrode connected to the one of the scanning lines, one of a source electrode and a drain electrode connected to the other of the source electrode and the drain electrode of the second transistor, and the other of the source electrode and the drain electrode connected to the one of the data lines;

a third transistor having a gate electrode connected to the one of the source electrode and the drain electrode of the first transistor, a source electrode connected to the other of the source electrode and the drain electrode of the first transistor, and a drain electrode connected to a first potential line; and a fourth transistor having a gate electrode connected to a drain electrode, the drain electrode connected to the other of the source electrode and the drain electrode of the second transistor, and a source electrode connected to a second potential line.

* * * * *